US009305758B2

(12) United States Patent
Kalinitchenko

(10) Patent No.: US 9,305,758 B2
(45) Date of Patent: Apr. 5, 2016

(54) INTERFACE FOR MASS SPECTROMETRY APPARATUS

(71) Applicant: Analytik Jena AG, Jena (DE)

(72) Inventor: Iouri Kalinitchenko, Berwick (AU)

( * ) Notice: Subject to any disclaimer, the term of this patent is extended or adjusted under 35 U.S.C. 154(b) by 0 days.

(21) Appl. No.: 14/379,712

(22) PCT Filed: Mar. 18, 2013

(86) PCT No.: PCT/AU2013/000271
§ 371 (c)(1),
(2) Date: Aug. 19, 2014

(87) PCT Pub. No.: WO2013/134833
PCT Pub. Date: Sep. 19, 2013

(65) Prior Publication Data

US 2015/0034816 A1 Feb. 5, 2015

(30) Foreign Application Priority Data

Mar. 16, 2012 (AU) ..... 2012901063

(51) Int. Cl.

| | |
|---|---|
| ***H01J 49/40*** | (2006.01) |
| ***H01J 49/06*** | (2006.01) |
| ***H01J 49/26*** | (2006.01) |
| *H01J 49/10* | (2006.01) |
| *H01J 49/00* | (2006.01) |

(52) U.S. Cl.
CPC ..... *H01J 49/067* (2013.01); *H01J 49/26* (2013.01); *H01J 49/009* (2013.01); *H01J 49/105* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 3,657,531 | A | 4/1972 | Evans et al. | |
| 5,401,962 | A | 3/1995 | Ferran | |
| 6,891,157 | B2 | 5/2005 | Bateman et al. | |
| 8,895,915 | B2 * | 11/2014 | Schwieters | H01J 49/025 250/281 |
| 2004/0217272 | A1 * | 11/2004 | Horning | H01J 49/4265 250/282 |
| 2008/0073515 | A1 | 3/2008 | Schoen | |
| 2009/0114809 | A1 * | 5/2009 | Hotchkis et al. | 250/282 |
| 2010/0193677 | A1 | 8/2010 | Freedman et al. | |

FOREIGN PATENT DOCUMENTS

| | | | |
|---|---|---|---|
| CN | 100550275 | C | 10/2009 |
| EP | 0813228 | B1 | 7/2002 |
| GB | 1233812 | A | 6/1971 |

* cited by examiner

*Primary Examiner* — Nicole Ippolito
(74) *Attorney, Agent, or Firm* — Benoit & Cote, Inc.

(57) ABSTRACT

There is provided an interface for use in sampling ions in a mass spectrometer, the interface being arranged for receiving a quantity of ions from an ion source and forming more than one ion beam therefrom, each ion beam being directed along a respective desired pathway.

24 Claims, 16 Drawing Sheets

INTERFACE FOR MASS SPECTROMETRY APPARATUS

FIELD OF THE INVENTION

The present invention concerns improvements in or relating to mass spectrometry. More particularly, the invention relates to improvements to sampling interfaces for use with mass spectrometry apparatus. In one aspect, the present invention relates to a sampling interface for use with an inductively coupled plasma mass spectrometer.

BACKGROUND OF THE INVENTION

In this specification, where a document, act or item of knowledge is referred to or discussed, this reference or discussion is not an admission that the document, act or item of knowledge or any combination thereof was at the priority date part of common general knowledge, or known to be relevant to an attempt to solve any problem with which this specification is concerned.

Mass spectrometers are specialist devices used to measure or analyse the mass-to-charge ratio of charged particles for the determination of the elemental composition of a sample or molecule.

A number of different techniques are used for such measurement purposes. One form of mass spectrometry involves the use of an inductively coupled plasma (ICP) for generating a plasma. The plasma vaporises and ionizes the sample so that ions from the sample can be introduced to a mass spectrometer for measurement/analysis.

As the mass spectrometer requires a vacuum in which to operate, the extraction and transfer of ions from the plasma involves a fraction of the ions formed by the plasma passing through an aperture of approximately 1 mm in size provided in a sampler, and then through an aperture of approximately 0.5 mm in size provided in a skimmer (typically referred to as sampler and skimmer cones respectively).

A number of problems are known to exist with prior art mass spectrometer arrangements, which serve to reduce their measurement sensitivity. Various solutions have been proposed to address these problems. One such proposal is reported by Houk et al ('Simultaneous Measurement of Ion Ratios by Inductively Coupled Plasma-Mass Spectrometry with a Twin-Quadrupole Instrument', Applied Spectroscopy, Vol. 48, Issue 11, pp. 1360-1366 (1994)), where it is proposed to split a single beam of ions within an ion optics unit into two independent and diverging ion beam streams. However, a likely deficiency with the proposed arrangement is the high potential for ion losses to occur within the 'splitting' mechanism, in which low energy ions are deflected away from their intended path of travel while high energy ions impact the surrounding walls of the mechanism. For these and other reasons, the resulting spectrometric analysis based on this approach is unlikely to be acceptable in a commercial mass spectrometry device.

SUMMARY OF THE INVENTION

According to a first principal aspect of the present invention there is provided an interface for use in sampling ions in a mass spectrometer for subsequent spectrometric analysis, the interface being capable of receiving a quantity of ions from an ion source and forming more than one ion beam therefrom, each ion beam being directed along a respective desired pathway.

According to one embodiment of the first aspect of the present invention, the interface is appropriately arranged for dividing the ions at or near the ion source into separate respective ion beams which each proceed along respective desired pathways within the mass spectrometer. Each pathway generally terminates with a respective ion detector unit. One significant advantage in forming plural or multiple ion beams at or near the ion source is thought to be that the ion beams formed tend to be more stable thereby providing an increased level of measurement sensitivity. Arrangements of the present invention therefore contrast prior art devices in which division of the ion beam occurs within the ion optics arrangement, which often leads to relatively poor and unreliable spectrometric measurements.

In one embodiment, the interface has more than one aperture provided therein, each aperture corresponding to a respective ion beam thus formed.

The interface may be arranged so that two or more of the desired pathways are substantially parallel with or to one another.

The interface may be substantially flat or curvilinear in shape. In some embodiments the interface may be concave or convex.

The interface may be arranged so as to receive a bias voltage potential.

The interface may comprise one or more chargeable elements arranged so as to be capable of having a bias voltage potential applied thereto. In accordance with one embodiment, a single chargeable element may comprise an electrode.

The voltage bias potential applied to the interface or to the or each chargeable element may be negative relative to the charge at the ion source.

The or each chargeable element may be substantially flat, or it may be curvilinear (for example, convex or concave) in shape.

The or each chargeable element may have more than one aperture provided therein, each aperture corresponding to a respective ion beam thus formed.

Two or more of the desired pathways may be attenuated (using, for example, appropriately configured ion optics units) so that the ions are directed toward, or pass through, a respective mass analyser arrangement (which tend to include a mass analyser unit and an associated ion detector unit).

The mass analyser units may be arranged substantially parallel to one another so as to minimise the overall footprint and/or envelope of the arrangement/apparatus. In such arrangements, the ion detector units are typically configured so that they are also parallel to one another.

The mass analyser arrangements may comprise mass analyser units having one or, more electrostatic poles. Preferably, the mass analyser arrangements comprise sequential multipole mass analyser units configured with, for example, monopole, dipole, quadrupole arrangements. Such arrangements are relatively inexpensive and small in size. However, it will be appreciated that the principles of the present invention could be employed with other types of mass analyser arrangements such as, for example simultaneous (such as, multi-collector magnetic sector mass spectrometers (MC-ICP-MS)) or time of flight (such as inductively coupled mass spectrometer (TOF-ICP-MS)) arrangements, despite such arrangements tending to be expensive and larger in size. In one respect, multi-collector mass analyser units typically have only a limited number of collectors (detectors) and operate (to a commercially acceptable degree of reliability) within certain isotropic mass ranges.

Using various embodiments of the present invention, mass spectrometry apparatus can be suitably arranged so that one or more selected mass analyser arrangements (typically including ion detector units) measure secondary ion fluxes independently of, and/or in parallel with, other mass analyser arrangements.

Embodiments of the present invention may therefore provide a mass analyser array comprising a number of mass analyser units (generally with their associated ion detector units). Preferably, the mass analyser units are disposed in a substantially parallel type arrangement relative to one another. One advantage of such arrangements is the potential reduction in spectrometric measurement time and/or the improvement in isotropic ratio measurement precision and accuracy.

Each of the separate ion beams may be generated by the interface at approximately atmospheric pressure. However, it will be appreciated that the separate ion beams may also be generated by the interface at substantially higher or lower pressures.

It will be appreciated that in various embodiments of the present invention, in accordance with any of the arrangements described herein, the division of the ion beam may be achieved at any stage along the pathway from the ion source to the mass detector, such as for example and without limitation:

in front of mass-analysers; and/or, in front of the ion optics arrangement if present; and/or, at the interface; and/or, within an ion beam manipulator compartment such as an ion cooler or ion thermalisation devices, and/or electrostatic collisional cell arrangements.

Thus, for the case of plasma mass spectroscopy, arrangements of the present invention may prove beneficial by assisting in the generation of stable multiple ion beams and which avoid, at least in part, dependence on the conditions of the plasma which can vary during operation (for example in inductively coupled mass spectrometry devices). For most cases, improved stability of the ion beam streams, when injected into mass analyser units, serve to improve the precision of the spectrometric measurement of the elements being analysed.

According to a further principal aspect of the present invention there is provided a sampling interface for use with mass spectrometry apparatus, the sampling interface being arranged so as to enable the sampling of ions in a mass spectrometer for subsequent spectrometric analysis, the sampling interface arranged for receiving a quantity of ions extracted from an ion source and forming more than one ion beam therefrom, each ion beam being directed along a respective desired pathway.

The sampling interface may include an interface arranged in accordance with any of the embodiments of the first principal aspect of the present invention.

In another embodiment, one or more of the pathways is attenuated so as to pass through at least one collisional cell or reaction cell.

One or more of the pathways may be attenuated so as to pass through respective mass analyser units.

In one embodiment, the sampling interface includes an interface arranged so as to form more than one ion beam, each ion beam having a pathway passing through a respective mass analyser unit.

The mass analyser units may be arranged substantially parallel to one another so as to minimise the overall footprint and/or envelope of the arrangement/apparatus.

Attenuation of the or each pathway may be performed using an ion optics apparatus.

Two or more of the pathways may be arranged substantially parallel to one another.

In a further embodiment, one or more of the mass analyser units comprises a multipole mass analyser unit.

One or more of the ion beams may pass through a region downstream of the interface which is arranged so as to minimise collisional scatter of the ions.

In one embodiment, the sampling interface may comprise a region downstream of the interface for accommodating a gas through which the ions may pass.

In another embodiment, a field having a selected bias voltage potential is provided in at least a portion of the downstream region through which the ions may pass.

The field having a selected bias voltage potential may be provided upstream or downstream of where the ion beam is divided into more than one separate ion beams. In some embodiments, one field may be provided upstream of where the ion beam is divided, and a further substantially similar field may be provided downstream of where the division takes place.

The bias voltage potential of the field may be a positive bias voltage potential.

Typically an energy component of the ions will be increased as they pass through the field charged in this way.

The bias voltage potential of the field may be selected so as to reduce collisional scatter caused when ions collide with particles of the gas as the ions pass through the field in the downstream region.

The bias voltage potential of the field may be selected in accordance with a correlation with a change in kinetic energy of the ions due to collisions with particles of the gas as the ions pass through the downstream region, so as to reduce collisional scatter.

The bias voltage potential of the field may be selected such that the signal strength (or sensitivity) of ions which reach a detector of the mass spectrometry apparatus is as strong as possible. Accordingly, when the signal strength is at a maximum, the degree of collisional scatter should be at a minimum.

In one embodiment, the bias voltage potential applied to the field is a function of the loss of ion energy due to ionic collisions which occur in the downstream region.

In another embodiment, the bias voltage potential of the field may be selected in accordance with a correlation with the pressure of gas in the downstream region, so as to reduce collisional scatter. Thus, the bias voltage potential of the field may be arranged so as to be variable in response to variation in the pressure of the gas in the downstream region.

A change in the pressure of the gas in the downstream region, such as an increase in pressure, may cause a commensurable increase in the number of ionic collisions which occur. Therefore, in one embodiment, a change in the bias voltage potential applied to the field may be selected so as to be commensurable with any change, such as an increase, in the pressure of the gas in the downstream region. However, the commensurable increase in the number of ionic collisions which occur as a result of an increase in gas pressure in the downstream region may not translate to the same increase in collisional scatter of the ions. This is because collisional scatter is generally a function of ion energy and/or the speed of an ion prior to a collision.

Accordingly, the bias voltage potential to be applied to the field will generally be a function of the collisional scatter of the ions due to ionic collisions and, in at least one embodiment, may be selected so as to determine the magnitude of the bias voltage potential which results in the maximum possible number of ions reaching the detector of a mass spectrometry apparatus (ie. minimizing collisional scatter).

It will be appreciated that any magnitude of bias voltage potential may be applied to the field.

Although other arrangements are envisaged, the downstream region will typically be, at least in part, defined by a chamber arranged to be sealed so that the enclosed gas or gases reside in the chamber under pressure.

In one typical embodiment, the downstream region is, or forms part of, a collision reaction interface (CRI).

Embodiments of the first and second principal aspects of the present invention may comprise any one or more of the following features:

The ion source may be provided at about atmospheric pressure.

Typically the ion source will be a plasma generated by an inductively coupled plasma (ICP), although other ion sources are envisaged within the scope of the invention.

In one embodiment of the above described aspects of the invention, the sampling interface may be arranged so as to be in electrical communication with a voltage source, so that the bias voltage potential may be applied to the field. The voltage source may be separate from the interface, or it may be arranged with the interface.

In a further embodiment of the above described aspects of the invention, the bias voltage potential of the field may be provided by a chargeable element arranged so as to be electrically coupleable to the voltage source. In this embodiment the chargeable element is arranged within the region so that the field is positioned relative to the desired pathway of the ions, so that passing ions gain energy potential from the field.

In one such embodiment, the chargeable element may have an aperture provided therein through which ions may pass.

In another embodiment, the chargeable element may be arranged so as to divide passing ions into more than one separate beam of ions. In such an arrangement, the chargeable element may be arranged in a manner that is substantially similar to the embodiments of the interface according to the first principal aspect of the present invention.

In another embodiment, the chargeable element is arranged so as to be electrically isolated from ground.

The chargeable element may be supported from the interface. In one arrangement, the chargeable element is supported on the downstream side of the interface.

The downstream region will typically be, at least in part, defined by a chamber arranged to be sealed so that the enclosed gas or gases reside in the chamber under pressure.

In another typical embodiment, the chargeable element is electrically isolated from the walls of the chamber defining the downstream region.

Where the downstream region is defined by a chamber, the chargeable element will typically be supported by one or more of the chamber walls.

The gas accommodated in the downstream region may be at least one of helium or hydrogen as is typically known in the art, or a mixture thereof. Another suitable gas or mixtures of two or more other suitable gases may be accommodated in the downstream region as desired.

In another embodiment, the sampling interface comprises an inlet arranged for extracting ions from the ion source.

In a further embodiment, the inlet is arranged so that the extracted ions may be divided into separate respective ion beams.

In one embodiment, the inlet may be substantially conical in shape having an aperture provided at or near the apex of the cone. The chargeable element may also be substantially conical in shape also having an aperture provided at or near the apex of the cone. In this arrangement, the apertures of both the inlet and the chargeable element are arranged so as to be substantially concentric with one another.

In other embodiments, the inlet, regardless of its shape, comprises more than one aperture so that the extracted ions may be divided into separate ion beams. The components downstream are therefore arranged so as to appropriately cater for the number of ion beams divided at the inlet. For the case where the inlet provides for the extraction of only a single beam of ions, the chargeable element, regardless of its shape, may comprise more than one aperture so that the ions may be divided into separate ion beams. For each of these embodiments, the inlet or chargeable element may be substantially flat or curvilinear in shape (ie. exhibiting concavity or convexity).

According to one embodiment, the inlet is a sampler having a sampler cone, and the chargeable element is a skimmer having a skimmer cone.

In a further embodiment, the chamber includes an inlet through which gas or a mixture of gases may be injected into the chamber. In one embodiment of this arrangement, the chargeable element has an inlet through which gas may be injected into the chamber.

According to further embodiments, the chamber may include an ion optics arrangement positioned generally downstream of the inlet and generally upstream of the interface (or substantially between the inlet and the interface). Suitable ion optics arrangements may include, but are not limited to, a 'chicane' or 'mirror' type ion optics arrangement.

Any of the arrangements of the sampling interface described herein may include one or more collisional cells. The or each collisional cell may be arranged so as to accommodate one or more reaction or collision gases such as ammonia, methane, oxygen, nitrogen, argon, neon, krypton, xenon, helium or hydrogen, or mixtures of any two or more of them, for reacting with ions extracted from the plasma. It will be appreciated that the latter examples are by no means exhaustive and that many other gases, or combinations thereof, may be suitable for use in such collisional cells.

Division of the ions into separate ion beams may occur within such collisional cell arrangements. In some embodiments, the division may occur at the entrance to a collisional cell.

The bias voltage potential of the field may be arranged so as to be variable in response to variations in the pressure of the gas or gases provided in the or each collisional cell.

The or each collisional cell may include one or more quadrupole arrangements.

According to another principal aspect of the present invention there is provided an interface or sampling interface according to any of the embodiments of the above described principal aspects of the invention, wherein the interface or sampling interface is arranged so as to be associable with at least one of the following mass spectrometry instrumentation: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromatography mass spectrometry (GC-MS), liquid chromatography mass spectrometry (LC-MS), and ion chromatography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmospheric pressure photo-ionization (DAPPI), and atmospheric or ambient desorption ionization (ADI). The skilled reader will appreciate that the latter list is not intended to be exhaustive, as other developing areas of mass spectrometry may benefit from the principles of the present invention.

According to a further principal aspect of the invention, there is provided a mass spectrometer having a sampling interface arranged according to any of the embodiments described above.

According to another principal aspect of the invention there is provided an inductively coupled plasma mass spectrometer having a sampling interface according to any of the embodiments described above.

According to a further principal aspect of the invention there is provided a plasma sampling interface for plasma mass spectrometry apparatus, the plasma sampling interface arranged so as to enable the sampling of ions from a plasma and introduction of the ions to a mass spectrometer for subsequent spectrometric analysis, the ions to be sampled being from a sample which has been converted into ions in the plasma, the plasma sampling interface arranged for receiving a quantity of ions extracted from the ion source and forming more than one ion beam, each ion beam being directed along a respective desired pathway.

The sampling interface of this aspect may incorporate any of the features described above.

The sampling interface may be arranged with an interface according to embodiments of the first principal aspect of the invention, the interface being capable of forming more than one ion beam therefrom, each ion beam being directed along a respective desired pathway.

The plasma sampling interface may be arranged to have a downstream region capable of accommodating a gas through which ions received from the plasma may pass.

The plasma sampling interface may further comprise a field between a sampler and the interface having a selected bias voltage potential provided in at least a portion of the region through which the ions may pass.

In one embodiment, a skimmer is provided and arranged downstream of the sampler. Both the sampler and skimmer are arranged so as to enable sampling of ions from the plasma for introduction to a mass spectrometer.

The sampling interface may be further arranged as so to be in electrical communication with a voltage source, so that the bias voltage potential may be applied to the field. The voltage source may be separate from the interface, or it may be arranged with the interface.

In one embodiment, the voltage potential of the field is provided by way of a chargeable element such as a skimmer or skimmer cone.

Division of the ions into more than one separate ion beams may occur by way of the arrangement of at least one of the chargeable element, the skimmer, or the sampler, being arranged in accordance in substantially the same manner as the above described interface.

The bias voltage potential of the field may be selected so as to reduce collisional scatter caused when ions collide with particles of the gas as the ions pass through the downstream region.

In one embodiment, the bias voltage potential applied to the skimmer may be selected in accordance with a correlation with a change in kinetic energy of the ions due to collisions with particles of gas as the ions pass through the downstream region.

In another embodiment, the bias voltage potential applied to the skimmer may be selected so as to reduce collisional scatter caused when ions collide with particles of the gas as the ions pass through the downstream region.

In another embodiment, the bias voltage potential applied to the skimmer may be selected in accordance with a correlation with the pressure of the gas in the region so as to reduce collisional scatter.

In one typical embodiment, the voltage source is arranged so that the bias voltage potential applied to the skimmer may vary in response to variation in the pressure of the gas in the region.

In another embodiment, the skimmer is arranged so as to be electrically isolated from ground. The bias voltage potential applied to the skimmer may be a positive bias voltage potential.

The skimmer may be supported from the inlet. In one arrangement the chargeable element is supported on the downstream side of the inlet.

In one embodiment the downstream region is, at least in part, defined by a chamber arranged to be sealed so that the enclosed gas or gases reside in the chamber under pressure.

The skimmer may be substantially conical in shape having an aperture provided at or near the apex of the cone. The sampler, if present, may also be substantially conical in shape and have an aperture provided at or near the apex of the cone. In this embodiment the apertures of the inlet and the chargeable element are arranged so as to be substantially concentric with one another.

In other embodiments, the inlet, regardless of its shape, comprises more than one aperture so that the extracted ions may be divided into separate ion beams. The components downstream are therefore arranged so as to appropriately cater for the number of ion beams divided at the inlet. For the case where the inlet provides for the extraction of only a single beam of ions, the chargeable element, regardless of shaping, may comprise more than one aperture so that the ions may be divided into separate ion beams. For each of these embodiments, the inlet or chargeable element may be substantially flat or curvilinear in shape (ie. exhibiting concavity or convexity).

In another embodiment, the chamber is arranged adjacent a downstream face of the skimmer.

In a further embodiment, the chamber includes an inlet through which the gas or mixture of gases may be injected into the chamber. The skimmer may be provided with an inlet through which gas may be injected into the chamber.

According to further embodiments, the chamber may include an ion optics arrangement positioned generally downstream of the skimmer. Suitable ion optics arrangements may include, but are not limited to, a 'chicane' or 'mirror' type ion optics arrangement.

According to a further principal aspect of the present invention there is provided a mass spectrometer having a sampling interface arranged in accordance with any of the above described embodiments.

According to another principal aspect of the present invention there is provided an inductively coupled plasma mass spectrometer having a plasma sampling interface arranged in accordance with any of the above described embodiments.

According to a further principal aspect of the present invention, there is provided a method for measuring a quantity of ions extracted from a sample, the method comprising forming more than one ion beam and directing said more than one ion beam along a respective intended pathway to at least one ion detector.

The method may further include directing one or more of said more than one ion beams so that they pass through a region arranged having a gas through which the ions may pass. A field having a selected bias voltage potential is typically provided in at least a portion of the region through which the ions may pass.

The region may also be arranged so as to accommodate a gas through which the ion beams may pass. The gas may be one selected for its ability to reduce or minimise collisional scatter.

The method may further include steps relating to the operation or use of any of the above described features.

BRIEF DESCRIPTION OF THE DRAWINGS

Embodiments of the invention will now be further explained and illustrated, by way of example only, with reference to any one or more of the accompanying drawings in which.

DETAILED DESCRIPTION

Figure 1:
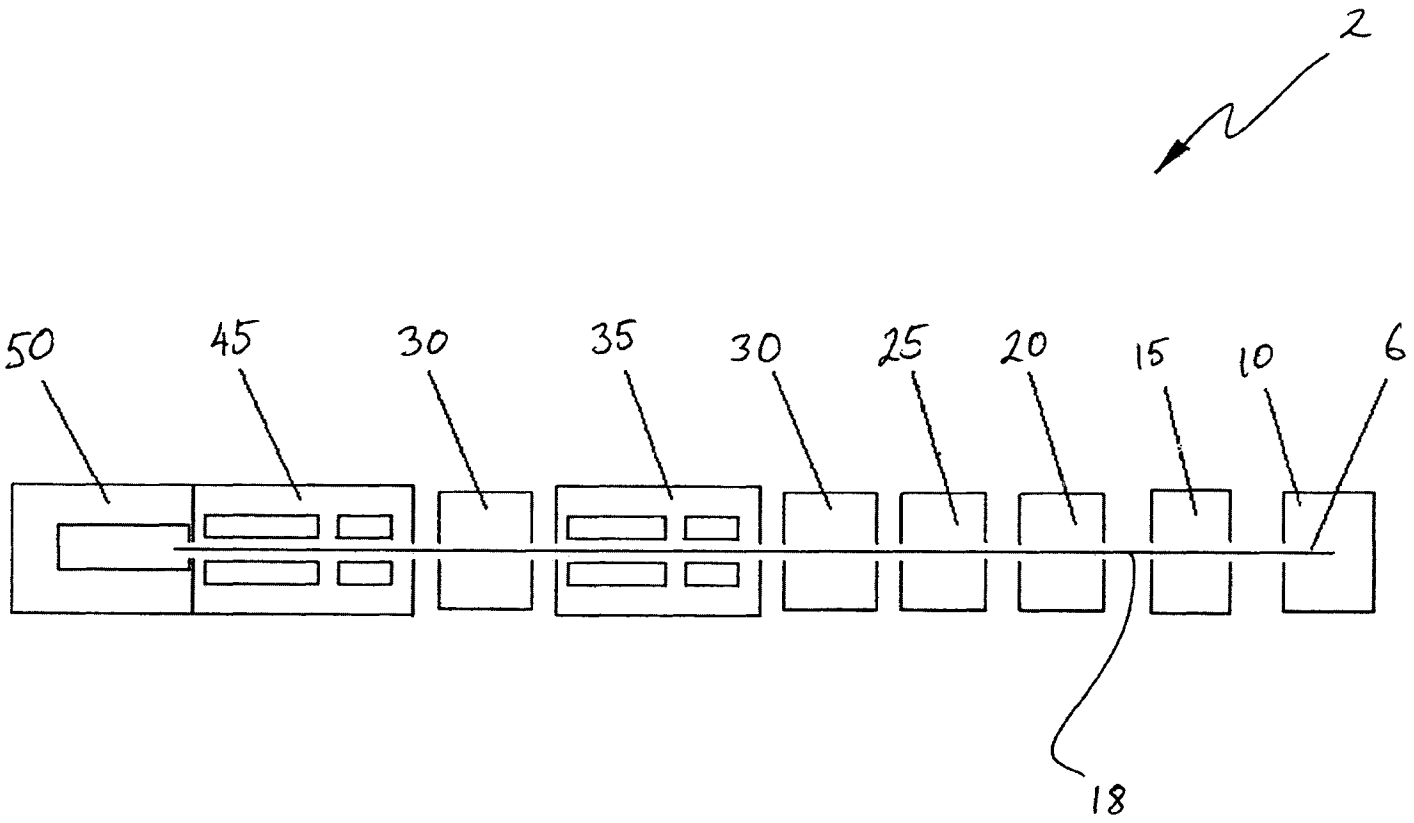
FIG. 1 shows a schematic representation of one arrangement of an inductively coupled plasma mass spectrometry apparatus.

For brevity, several embodiments of the present invention will be described with specific regard to inductively coupled mass spectrometry (ICP-MS) apparatus. However, it will be appreciated that the substance of the described embodiments may be readily applied to any mass spectrometry apparatus, including those having any type of collisional atmosphere (including, but not limited to, multi-pole collisional or reaction cells) arrangements used for selective ion particle fragmentation, attenuation, reaction, collisional scattering, manipulation, and redistribution with the purpose of mass-spectra modification.

Accordingly, the following mass spectrometry apparatus may benefit from the principles of the present invention: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromatography mass spectrometry (GC-MS), liquid chromatography mass spectrometry (LC-MS), and ion chromatography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmospheric pressure photo-ionization (DAPPI), and atmospheric or ambient desorption ionization (ADI). The skilled reader will appreciate that the latter list is not intended to be exhaustive, as other developing areas of mass spectrometry may benefit from the principles of the present invention.

By way of brief explanation, in the case of ICP-MS apparatus, a 'Campargue' type configuration plasma sampling interface is often utilized to provide for the production and transfer of ions from a test sample to a mass spectrometer. An interface of this configuration generally consists of two electrically grounded components: a first component generally referred to as a sampler (or sampler cone), which is placed adjacent the plasma to serve as an inlet for receiving ions produced by the plasma; and a second component commonly known as a skimmer (or skimmer cone), which is positioned downstream of the sampler so that ions pass therethrough en-route to the mass spectrometer. The skimmer generally includes an aperture through which the ions pass. The purpose of the sampler and skimmer arrangement is to allow the ions to pass (via respective apertures) into a vacuum environment required for operation by the mass spectrometer. The vacuum is generally created and maintained by a multi-stage pump arrangement in which the first stage attempts to remove most of the gas associated with the plasma. One or more further vacuum stages may be used to further purify the atmosphere prior to the ions reaching the mass spectrometer. In most systems, an ion optics or extraction lens arrangement is provided and positioned immediately downstream of the skimmer for separating the ions from UV photons, energetic neutrals, and any further solid particles that may be carried into the instrument from the plasma.

Typical ICP mass spectrometers have an ion beam which is extracted from an ion source, travels along an intended pathway as a single beam, and passes through all the mass spectrometer compartments sequentially. The sample introduction system supplies the ion source with material to be analysed. The ion source is the part of the mass spectrometer apparatus where ions are formed before they are extracted into the ion optics compartment by way of an extractor or interface. The ions may be formed in the plasma or generated by other known means in the art such as, for example, under the influence of other particles (electrons, neutrals, ions, photons, chemo ionisation, etc.,) or in presence of fields (electrostatic and/or magnetic). Ion sources may operate in different pressure conditions, such as atmospheric, or other environments having relatively higher or lower pressure conditions.

Most mass spectrometer devices typically include one or more ion optics arrangements which are configured so as to focus and move the ions into an ion beam manipulator (if used), being any known collisional or reaction cell. The purpose of an ion optics arrangement is to modify the ion beam by physical and/or chemical means for specific spectroscopic needs. For example, in the ICP-MS field, providing an 'interference' environment (one containing a specific gas or environment which purposefully interferes with an unwanted particle or particles known to be present in the ion beam) can improve the measurement of a specific kind of ion which is desired to be measured.

Mass spectrometry can often benefit by using a number of mass-analyser arrangements in sequence and ion beam manipulators of different kinds.

Quadrupole mass-filters operate sequentially. The spectra is obtained in sequence allowing only one mass-to-charge ratio (m/z) measurement at a time, and can therefore be time consuming when many masses are needed to be measured. Furthermore, precise isotropic ratio measurements using such sequential methods can be problematic when the ion source and/or sample introduction systems oscillate or flicker, creating unstable (in time) ion beams for subsequent measurement.

Flickering is often an instability measurement problem typically associated with atmospheric pressure ion sources (such as inductively coupled plasma, microwave plasma, or laser-induced plasma), but electrodes charging within the interface and ion optics units can cause short and long term drift problems which can tend to impact upon the precision of isotropic and elemental measurements.

There are other types of mass-analysers—simultaneous, for example multi-collector magnetic sector mass-spectrometers (MC-ICP-MS), or time-time-of-flight (TOF ICP-MS). Needless to say, these mass-analysers are generally more expensive and in some cases are large in size. Multi-collectors are not capable of covering all mass ranges, typically have only a limited number of collectors (mass detectors), and operate within a certain isotropic mass range.

Many anticipated embodiments of the present invention incorporate sequential multipole mass-analysers (monopole, dipole, quadrupole, etc.) which are typically relatively inexpensive and small in dimension. Therefore, the combination of a number (N) of such devices in 'parallel' arrangements (into mass-analyser arrays) can yield reductions in measurement time and improve isotope ratio precision and accuracy.

Therefore, following from the above, FIG. 1 shows a conventional arrangement 2 of a typical mass spectrometry apparatus. Broadly, and as foreshadowed above, the arrangement 2 firstly involves the provision of a sample 6 of a substance of material in a sampler 10 for testing by an ion detection unit 50. The sample 6 is transferred to a subsequent compartment arranged to convert the sample 6 into a source 15 of ions from which a quantity of ions is extracted therefrom by a sampling interface 20. The purpose of the sampling interface 20 is essentially to extract the quantity of ions from source 15 and provide a beam of ions 18 having a desired pathway.

The beam of ions 18 then passes into an ion optics arrangement 25 which serves to provide focus or directioning to the ion beam 18. In some instances, the path of the ion beam 18 at this stage may be linear. However, in many arrangements, the ion beam 18 may be specifically directed or manipulated so as to alter the direction of the pathway to cause the removal of unwanted particles from the beam. It will be appreciated that many filtering arrangements will be known to those skilled in the art.

The beam 18 may be directed so as to pass through a collisional or reaction cell 30 which is arranged to provide an additional filtering mechanism by removing interfering ions through ion/neutral reaction. The collisional or reaction cell 30 may comprise a specific reacting gas provided therein and pressurized so as to filter a particle known to be present in the ion beam 18.

The beam 18 may be further directed so as to pass through a first mass filter 35 arrangement which seeks to separate ions based upon their mass-charge ratio. Generally, quadrupole mass filter arrangements are employed which use oscillating electric fields to stabilize or destabilize the paths of ions passing through a radio frequency (RF) field created between four parallel rods. Only ions in a certain range of mass-charge ratio are passed through the system at any time, but changes to the potentials on the rods allow a wide range of m/z values to be swept rapidly, either continuously or in a succession of discrete stages.

For the arrangement shown, on exiting the first mass filter 35, the ion beam 18 passes through another collisional or reaction cell 30, and into a second mass filter 45.

The second mass filter 45 is arranged adjacent the ion detector unit 50 so that, on exiting the second mass filter 45, the ion beam 18 is then directed to the ion detector unit 50 for analysis. The skilled person will appreciate that the arrangement in FIG. 1 is generally indicative of conventional inductively coupled plasma mass spectrometer arrangements.

Figure 2:
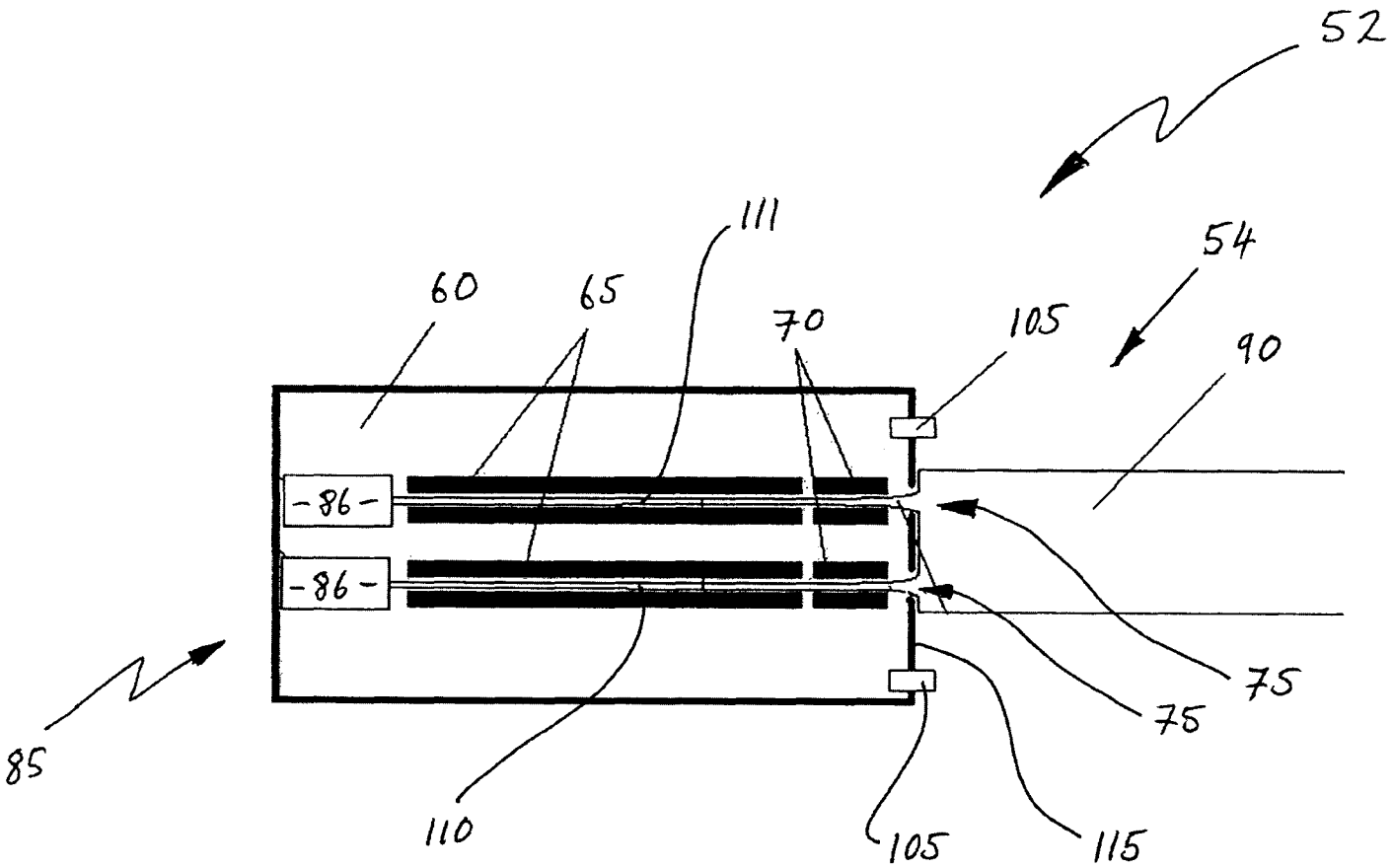
FIG. 2 shows a schematic representation of an embodiment of a mass analyser arrangement for use in a mass spectrometry apparatus arranged in accordance with the present invention.

FIG. 2 shows a simplified embodiment of an ion sampling arrangement 52 for use with an inductively coupled plasma mass spectrometer. In the arrangement shown, an interface 54 is provided in which a quantity of ions is received from an ion source (by way of ion beam 90), and two ion beams 110 and 111 are formed at the entrance to a mass analyser array 60. The interface 54 is arranged such that each of ion beams 110 and 111 is directed along a respective desired pathway. In the embodiment shown, the pathways of ion beams 110 and 111 enter the mass analyser array 60 by way of inlets 75 provided in a chargeable component such as inlet lens 115, and are directed through respective mass analyser units 65 arranged parallel to one another within the mass analyser array 60.

For the embodiment shown, the inlet lens 115 is provided at an entrance wall of the mass analyser array 60. However, it will be appreciated that the inlet lens 115 may in itself comprise a separate component (see further below). In each instance, the inlet lens 115 may be substantially flat or be of any curvilinear shape (eg. convex or concave) as may be required.

The mass analyser array 60 further includes a detector array 85 comprising two detector units 86, each arranged at downstream ends of a respective mass analyser unit 65. The mass analyser units 65 of the mass analyser array 60 are each quadrupole mass analysers having respective sets of metallic fringing rods 70. It will be understood that each ion beam 110 and 111 is arranged so as to carry respective ion beams to respective detector units 86 for measurement of the ions carried thereby.

The embodiment shown in FIG. 2 shows how the flux (being substantially large in diameter) of particles of interest (or ion beam) can be reduced so as to enter the mass analyser array 60.

Figure 3:
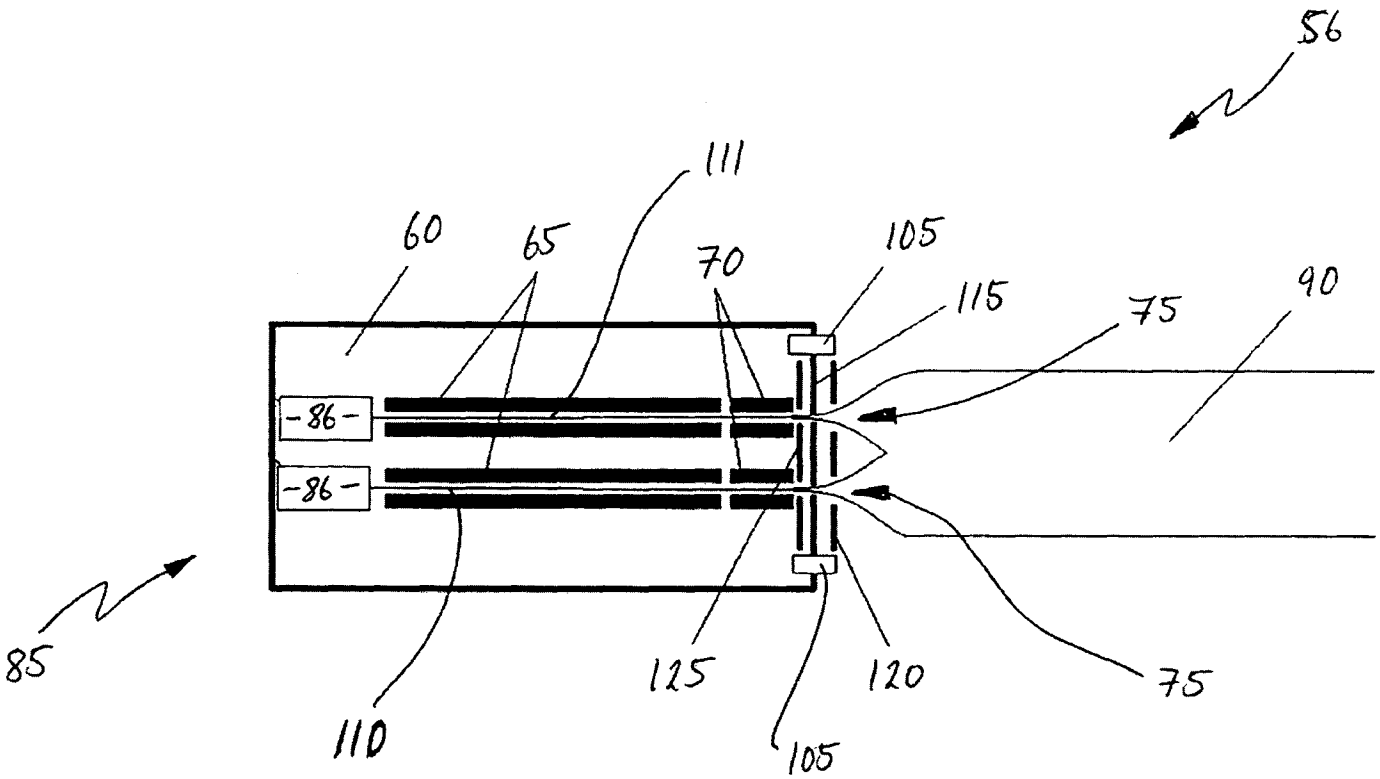
FIG. 3 shows a schematic representation of another embodiment of a mass analyser arrangement for use in a mass spectrometry apparatus arranged in accordance with the present invention.

FIG. 3 shows a further arrangement 56 in which the upstream end of the mass analyser array 60 comprises a pre-entrance lens 120 arranged on the external side of the inlet lens 115, and a post-entrance lens 125 arranged on the internal side of the inlet lens 115. The arrangement shown illustrates a multiple lens configuration which can be used to divide and focus the single ion beam into respective quadrupole mass analyser units (65). In this arrangement, isolators 105 are arranged with the mass analyser array 60 so that a voltage bias may be applied to the inlet lens 115 in order to further energise the ions in the passing ion beam.

Generally, the bias voltage applied to inlet lens 115 is negative relative to the charge of the ion source. However, it will appreciated that the bias voltage could be any negative voltage depending, at least in part, on the desired focus characteristics required and/or the geometry or arrangement (such as number) of the lenses used (more than one lens 115 may be employed—see for example the arrangements shown in FIGS. 9A and 9B).

FIGS. 4A and 4B both show an arrangement of a further embodiment of the mass analyser array 60 having four individual mass analyser units 65 arranged parallel with one another in a 2×2 configuration, and through which respective ion beams 110*a*, 110*b*, 111*a*, and 111*b* pass. The mass analyser array 60 comprises four inlets 75 arranged on an inlet lens 115 at an upstream end through which each of the ion beams enter their respective mass analyser units 65. The mass analyser array 60 further includes a further embodiment of the ion detector array 85 having four ion detector units 86 each arranged at a downstream end of respective mass analyser units 65. In the arrangement shown, each mass analyser array 60 is a quadrupole mass analyser having metallic fringing rods 70.

Thus, as shown in FIGS. 2 and 3, the forming of each respective ion beam occurs at the entrance to the mass analyser array 60. Therefore, in each of the arrangements 52, 56 shown in FIGS. 2 and 3 respectively, the separation of the ion beam 18 is achieved at the inlets 75 to each of the respective mass analyser units 65.

Figure 4:
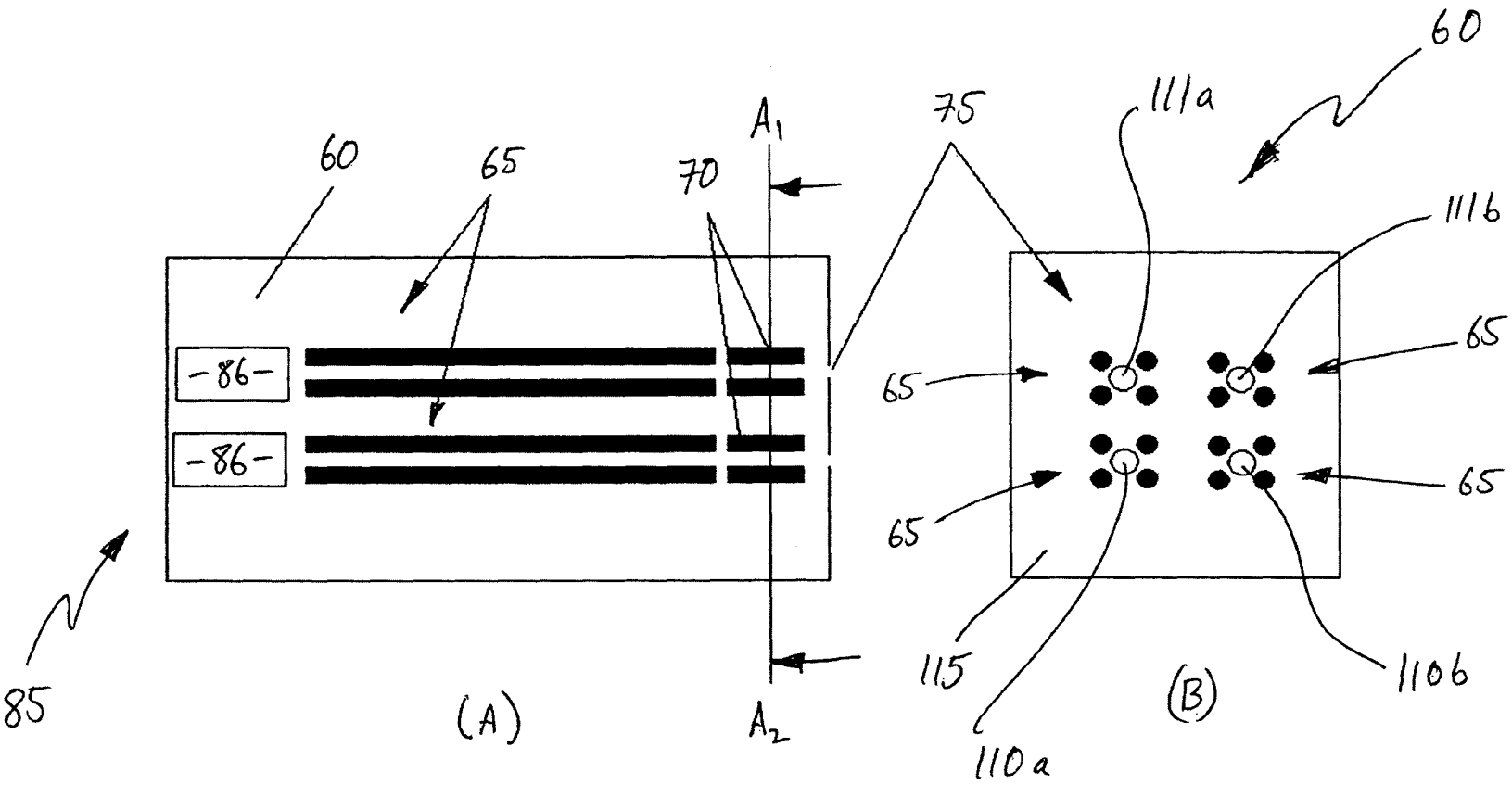
FIG. 4A shows a schematic representation of one embodiment of a mass analyser arrangement for use in a mass spectrometry apparatus arranged in accordance with the present invention.
FIG. 4B shows a cross section through $A_1$-$A_2$ of the mass analyser shown in FIG. 4A.
Figure 5:
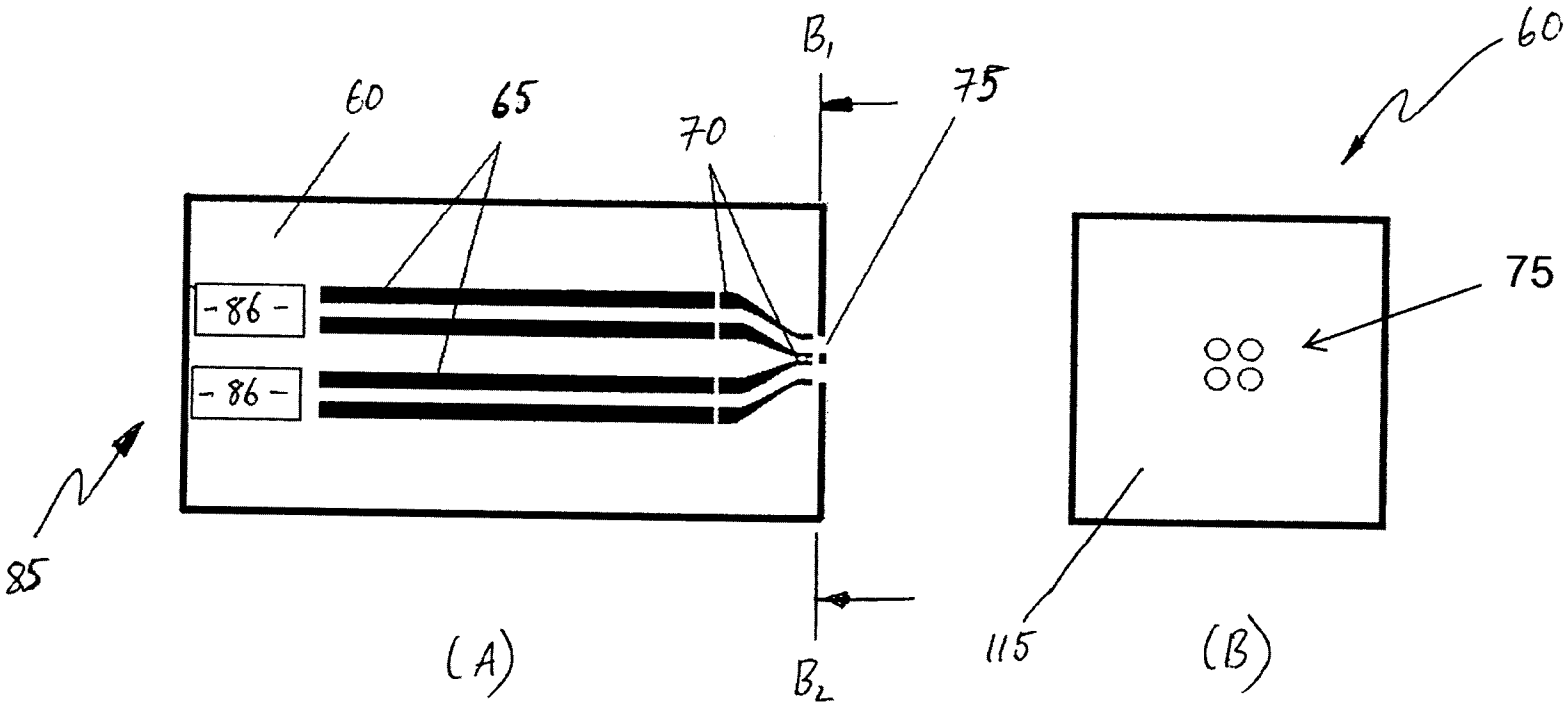
FIG. 5A shows a schematic representation of another embodiment of a mass analyser arrangement for use in a mass spectrometry apparatus arranged in accordance with the present invention.
FIG. 5B shows a cross section through $B_1$-$B_2$ of the mass analyser shown in FIG. 5A.

FIG. 5 shows a variation of the arrangement shown in FIG. 4, whereby the mass analyser units 65 each comprise metallic fringing rods 70 which are curved and arranged to conduct or provide guidance for the ions in each of the respective ion beams to respective mass analyser units 65. The embodiment shown in FIG. 5 retains the 2×2 parallel configuration of the mass analyser array 60 shown in FIG. 4, but allows the inlets 75 to be spaced much closer together. It will be appreciated that one advantage of this arrangement is that it is relatively easier to control the ion beam when the inlets 75 are spaced much closer together (practically, controlling the ion beam when the inlets are spaced further apart can add additional complexity to such arrangements). In this regard, arrangements of this type may be operable using only a single ion optics unit.

Figure 6:
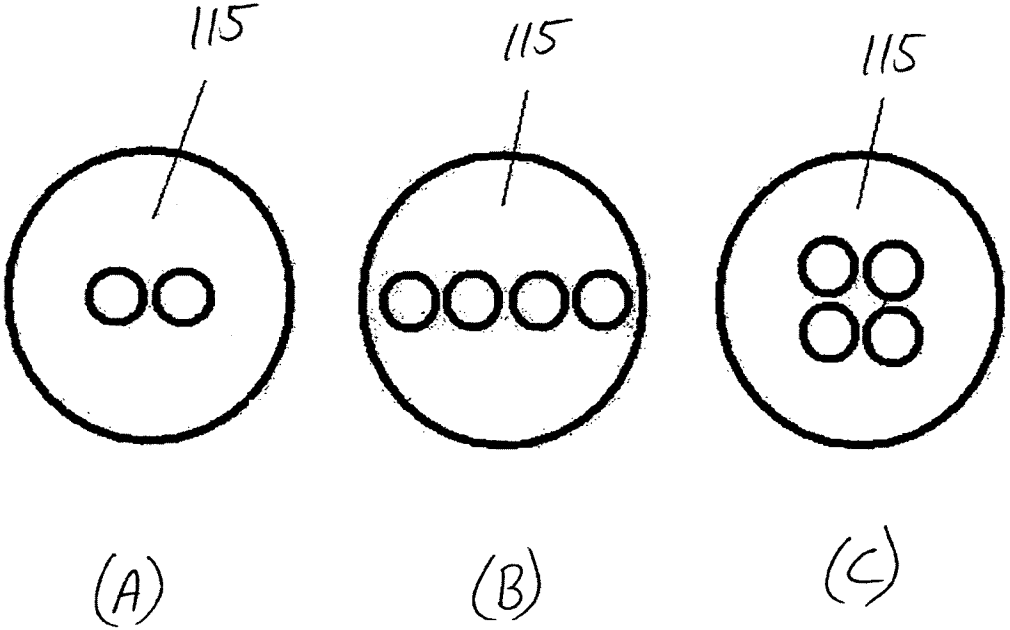
FIGS. 6A through 6C each show a variety of arrangements for respective extraction lenses for use with a mass spectrometry apparatus.

It will be appreciated that the inlets 75 of the inlet lens 115 may be arranged in various configurations as shown in FIGS. 6A to 6C. Furthermore, and as foreshadowed above, the inlet lens 115 may be arranged so as to be curvilinear (such as convex or concave in shape) so as to direct or focus the ion beam in a desired manner.

Figure 7:
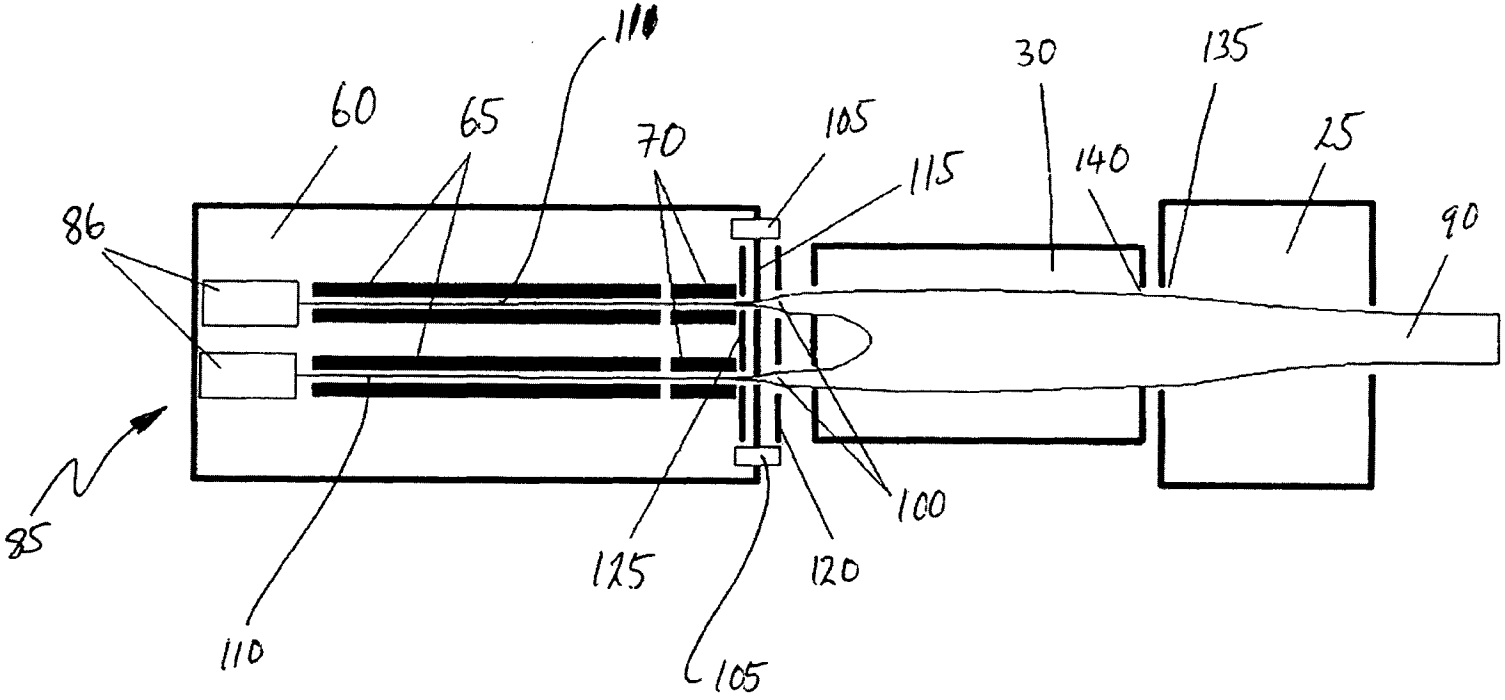
FIG. 7 shows a schematic representation of a further embodiment of a mass analyser arrangement for use in a mass spectrometry apparatus arranged in accordance with the present invention.

FIG. 7 shows another arrangement in which the ion beam is divided into two beams within a collisional or reaction cell 30 (sometimes referred to as an ion cooler). The ion beam 90 passes through a particle extractor or ion optics arrangement 25 and travels (through apertures 135 and 140) into the collisional or reaction cell 30. Within the collisional or reaction cell 30, the division (100) of the ion beam 90 is influenced by a static or dynamic (in time) electric field (other embodiments may provide a similar influence by way of magnetic fields). However, it will be appreciated that a division using static/dynamic electric and/or magnetic fields could be arranged to occur in any other compartment of the mass spectrometer through which the single ion beam 90 passes.

Once the ion beam is divided (potentially into N>1 separate beams), each individual beam exits the collisional or reaction cell 30 through aperture 100. Both beams (110, 111) then enter the mass analyser array 60 and travel through respective mass analyser units 65.

Figure 8:
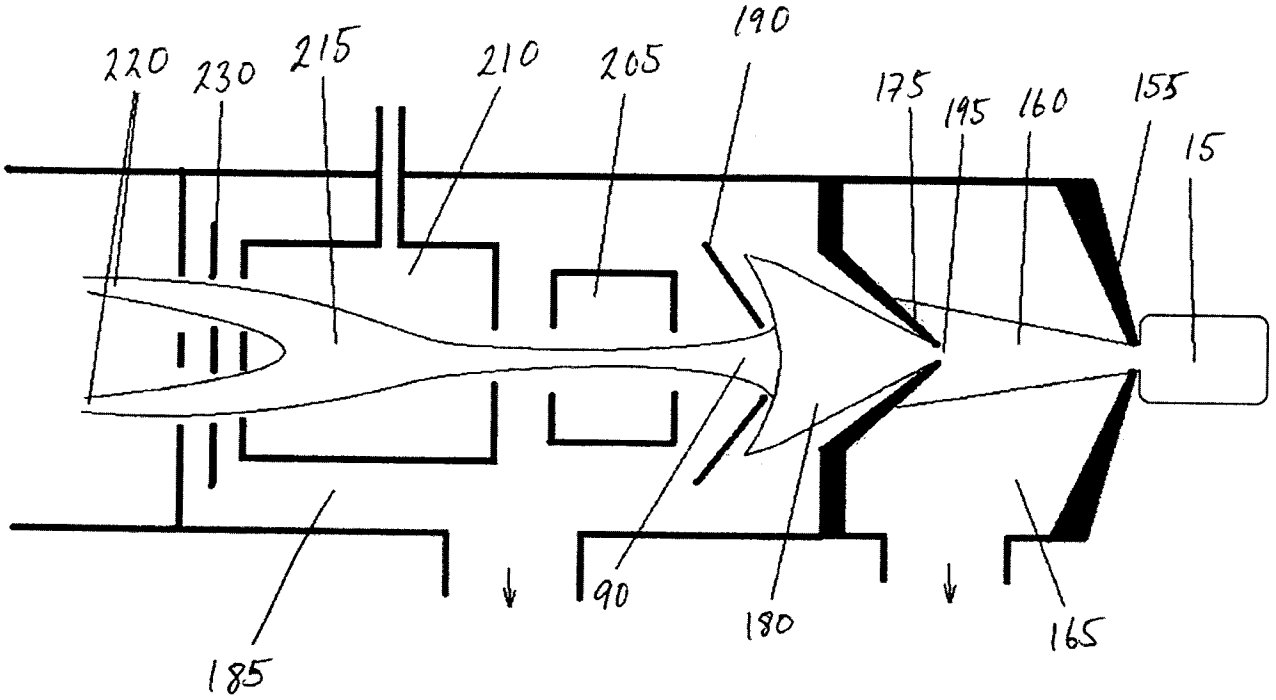
FIG. 8 shows a schematic representation of another embodiment of a mass analyser arrangement for use in a mass spectrometry apparatus arranged in accordance with the present invention.

A similar arrangement is shown in FIG. 8. The embodiment includes many of the features typical of Campargue arrangements as they relate to ICP-MS. Notably, the plasma is provided by way of a source of ions 15 and introduced into the apparatus by way of an orifice provided in sampler cone 155. The plasma is expanded (160) within the first chamber 165 (generally configured as a vacuum chamber) where it passes through orifice 195 of skimmer cone 175. The plasma expands (180) into a second chamber 185 (generally configured as a further vacuum chamber) once it has passed through orifice 195 and engages with extraction lens 190 provided with a DC voltage bias so as to assist in the extraction of the ions from the plasma. The resulting ion beam (single beam) 90 then enters the ion optics unit 205.

As previously stated, typical plasma mass-spectrometers consist of an interface and extraction lens and ion optics units arranged to transport only a single ion beam. The division (215) of the ion beam (90) may occur within an electrostatic collisional or reaction cell 210 following routing through the first chamber 165 and ion optics unit 205. This may happen because the single beam diffuses within the cell, loses energy and could be subject to extraction (or pushing) forces established by the electrostatic field coming from the electrostatic cell itself or from an external ion optical element. In this regard, the embodiment shown benefits from the inclusion of an ion optical element 230 which assists in the extraction of the ions from the electrostatic collisional or reaction cell 210 (similar to lens 115)—this generally occurs while a voltage is applied to the cell so that ions are effectively repelled therefrom. Upon exiting from the electrostatic collisional or reaction cell 210 the divided ion beams (each 220) pass through respective quadrupole mass analyser units (not shown) enroute to the mass detector array (also not shown).

Thus, the splitting of the ion beam may occur at any stage in the pathway from the ion source to the mass detector array. For the case of ICP-MS, the most practical means of achieving this is to consider the source of ions when operating at any given pressure. For example, ICP-MS instruments can have ICP operating at atmospheric pressure, but lower or higher pressures could also be beneficial to the performance of the instrument, ie. plasma created in a separate sealed compartment with controlled pressure. This could also be arranged for micro-wave plasma, glow discharge plasma, and laser induced plasma source mass-spectrometers, all of which are not limited to atmospheric pressure.

Figure 9A:
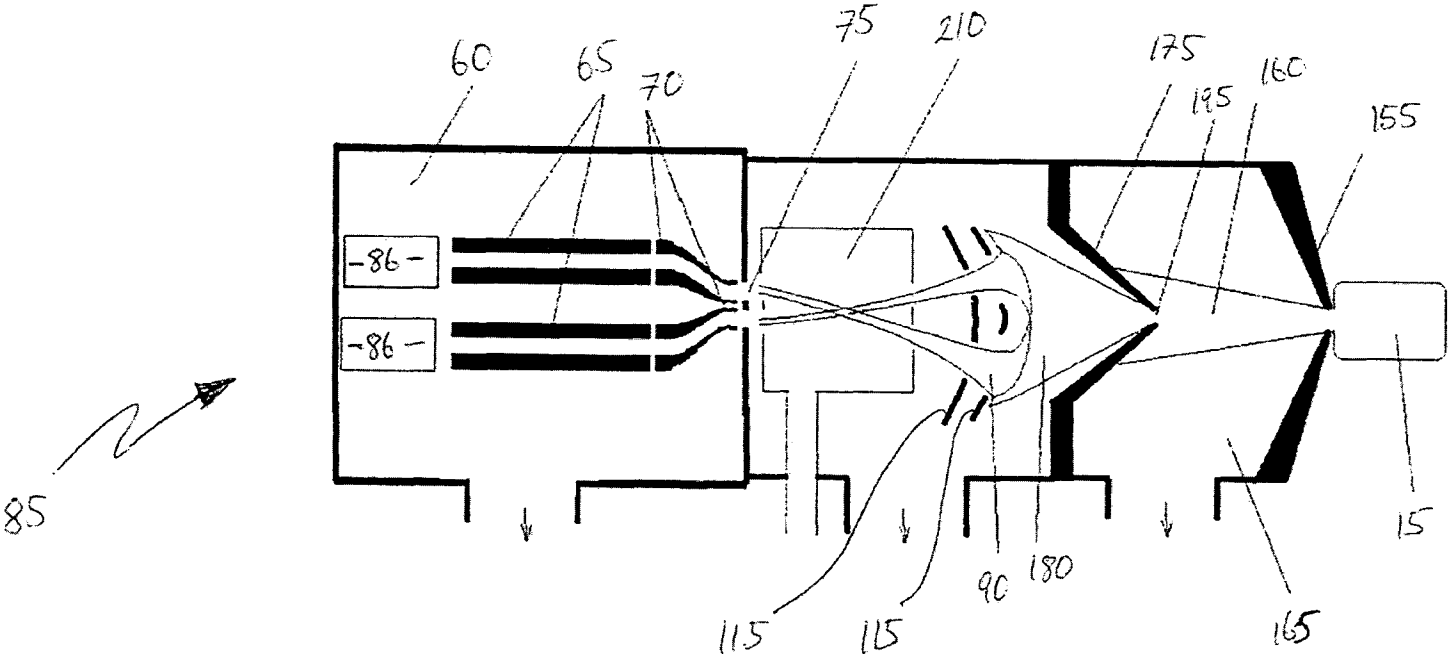
FIG. 9A shows a schematic representation of yet another embodiment of a mass analyser arrangement for use in a mass spectrometry apparatus arranged in accordance with the present invention.
Figure 9B:
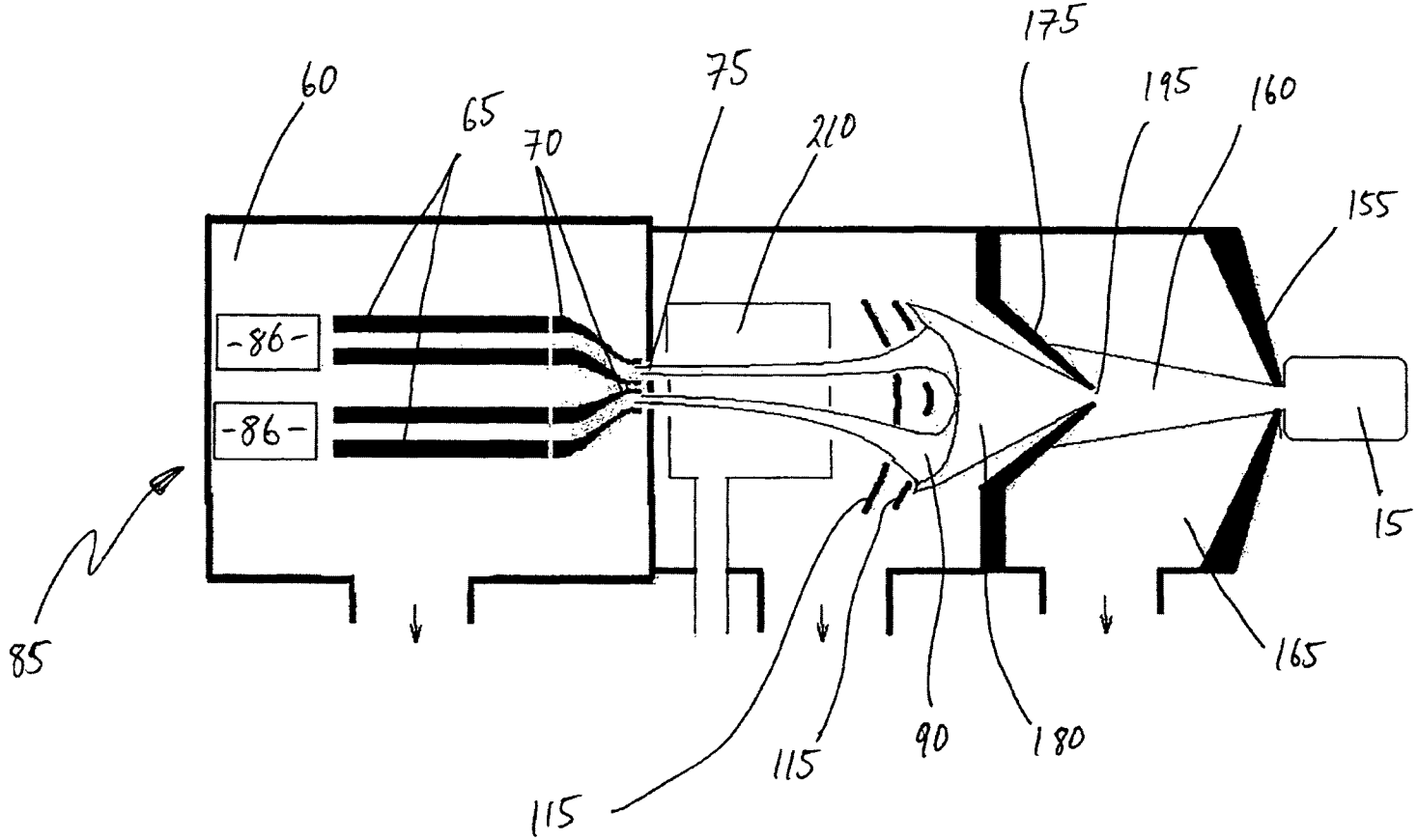
FIG. 9B shows a schematic representation of a further embodiment of a mass analyzer arrangement for use in a mass spectrometry apparatus arranged in accordance with the present invention.

FIG. 9 shows yet another arrangement of a preferred embodiment which retains many of the features shown in FIG. 7 and FIG. 8. In the arrangement shown, the plasma jet encounters the curved embodiments of lenses 115 which provide multiple ion beams which are focused into an electrostatic collisional or reaction cell 210 (or sometimes referred to as an ion cooler). The dual ion beams exit the electrostatic collisional or reaction cell 210 and enter respective mass analyser units 65 by way of inlets 75, and are guided between metallic fringing rods 70 (configured to be substantially curved in the arrangements shown in both FIGS. 9A and 9B) toward ion detector units 86 of the ion detector array 85 (all shown to be housed in a third vacuum chamber).

Therefore, the single incoming ion beam can be divided after the skimmer cone 175 using an extraction process involving one or more lenses 115 (two curved lenses 115 are included in the arrangements shown in FIG. 9A and FIG. 9B). The ion beams may travel into the collisional or reaction cell while either travelling parallel (shown in FIG. 9B) to one another, or in a manner which causes each beam to cross their respective trajectories (shown in FIG. 9A). When ions enter the collisional or reaction cell 210 they may undergo chemical/physical reactions with another substance (molecules, ions, electrons, photons) in order to modify the initial spectra. For the case of ICP-MS this may be needed in order to reduce interferences, but in, for example, molecular MS, it may be needed for ion fragmentation or ion-molecular association reactions.

The arrangement shown in FIG. 9B could be configured so that the collisional or reaction cell 210 is replaced by a compartment housing an ion optics arrangement (such as for example one or more iron mirror deflector/reflector device(s)), through which the ion beams flow substantially parallel relative to one another.

It would be readily appreciated by the skilled person that other embodiments of the arrangements shown in FIGS. 9A and 9B could be realized by the collisional or reaction cell 210 being replaced by a number of different components, the purpose of which being to reduce the presence of unwanted particles so as to maximize the signal strength of each respective ion beam.

In view of the above, it will be appreciated that the division of the ion beam, or the flux containing the particles of interest, could be achieved at any stage along the pathway from the ion source to the mass detector, such as for example and without limitation:

- in front of a mass-analyser unit; and/or,
- in front of the ion optics arrangement if present; and/or,
- at the interface or sampler units; and/or
- within an ion beam manipulator compartment such as an ion cooler or ion thermalisation devices, and/or electrostatic collisional cell arrangements.

Embodiments of the present invention shown and described herein serve to strengthen the ion beam so as to increase measurement sensitivity of the ions at the ion detector unit. However, it will be appreciated that other embodiments of the present invention may be arranged so as to further reduce the degree of collisional scatter. In this regard, embodiments of the present invention discussed above may be arranged so as to exploit the substance of various arrangements described and shown in Australian provisional application no 2010905248, the contents of which are incorporated herein by reference. It will therefore be appreciated that the concept of dividing a single ion beam into multiple ion beams can be combined with the concept of providing a region, through which the ion beams may pass (ie. the single ion beam or stream or any one or more of the divided ion beams or streams), having a selected bias voltage potential arranged to energise the ions in the or each respective passing ion beam in order to improve the performance of the measurement sensitivity of the ions at the ion detector unit.

The following discussion serves to describe a number of embodiments of sampling interface arrangements in which a field having a selected bias voltage potential is provided in at least a portion of the downstream region through which the ions beams (single or multiple) may pass.

Figure 10:
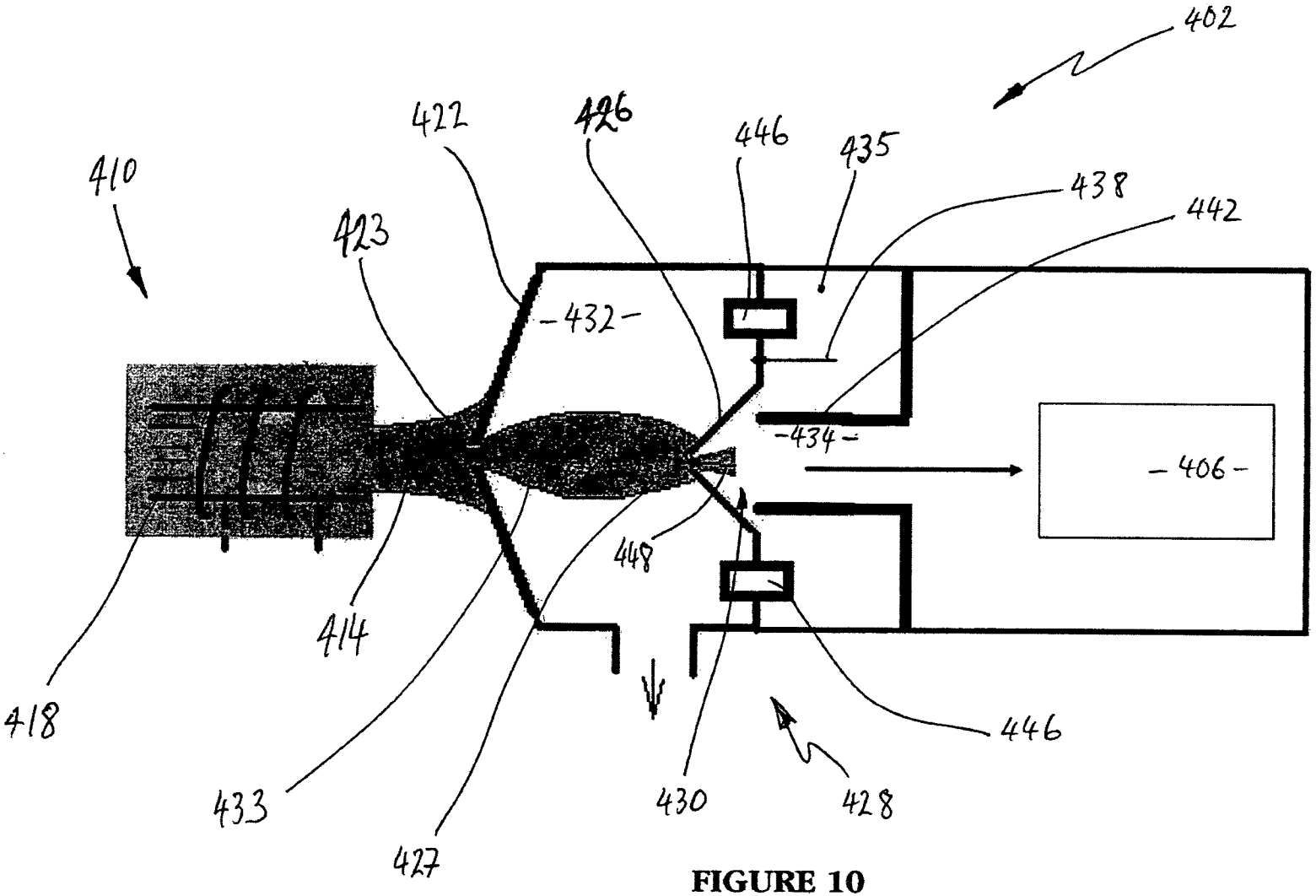
FIG. 10 shows a schematic representation of an arrangement of one embodiment of an inductively coupled plasma mass spectrometry (ICP-MS) apparatus which may be arranged for use with the present invention.

FIG. 10 shows one embodiment of a sampling interface 402 as configured using a two aperture ICP-MS 'Campargue' interface arrangement for use with an ICP-MS device. An inductively coupled plasma (ICP) torch 410 is provided in order to produce a plasma field 414. During operation, a test sample 418 is introduced into the plasma field 414 where the sample is vaporised and converted into ions for analysis by mass spectrometer detector 406. It will be appreciated that the method of producing the ions will depend upon the type of mass spectrometry instrumentation considered, however, for present purposes, the ions emanate from the plasma. It will be appreciated that various methods of producing test sample 418 are known in the art and will not be discussed further herein.

Ions from test sample 418 are sampled from the plasma field 414 by sampling interface 402. For the embodiment shown in FIG. 10, the sampling interface 402 includes an inlet such as, in the case of an ICP-MS arrangement, a sampler 422 (or sometimes referred to in the art as a sampler cone) arranged adjacent the plasma torch 410 for receiving ions from the plasma field 414. The sampler 422 is arranged for receiving a quantity of ions from plasma field 414. At a predetermined stage within the sampling interface 402, the plasma field, or incoming single beam of ions, may be divided into more than ion separate ion beam. From the point of division, each ion beam is then directed along a respective desired pathway so as to carry the respective ion beams to a respective detector unit. As foreshadowed above, the division of the ions may occur at any stage along the intended pathway enroute to the mass spectrometer detector 406 (or ion detector).

For convenience, only a single ion beam is shown in FIGS. 10 to 15 but it will be appreciated that embodiments of the arrangements shown may be realized whereby one or more further ion beams may be formed in parallel configurations or configurations where the trajectories of the respective ion beams may cross. The purpose of the embodiments in FIGS. 10 to 15 is to illustrate the concept of there being provided one or more regions downstream of the ion source, each region having a field having a selected voltage potential through which ions may pass. It will be appreciated that one or more divided ion beams may pass, either together or separately, through one or more of such regions.

The plasma field 414, initially at atmospheric pressure, expands as a plasma expansion jet 433 within a first vacuum chamber 432 (typical pressure being in the order of from 1-10 Torr).

A region (hereinafter collisional region 430), provided within a second chamber 435 downstream of the sampler 422, accommodates a gas (hereinafter collisional gas 434) through which the ions pass. At least a portion of the collisional region 430 is arranged so as to provide a field having a selected bias voltage potential through which the ions may pass. This arrangement allows an energy component of the ions to be increased as they pass through the field. For the embodiment shown in FIG. 10, the bias voltage potential of the field is provided by way of a chargeable element such as a skimmer 426 (in the case of an ICP-MS arrangement) being arranged in electrical communication with a voltage source 438.

Skimmer 426 (or sometimes referred to in the art as a skimmer cone) is generally positioned downstream of the sampler 422. Sampler 422 and skimmer 426 are arranged relative to one another so as to enable sampling of the ions from the plasma field 414 for introduction to mass spectrometer detector 406. The distance between respective apertures 423, 427 of the sampler 422 and the skimmer 426 can be between 5-30 mm. Skimmer 426 is arranged so that it is isolated from the sampling interface 402 and allowed to 'float' by way of an isolating assembly 428 using isolators 446.

The voltage potential applied to the skimmer 426 is selected in accordance with a correlation with the kinetic energy losses suffered by the ions caused by the effects of collisional scattering as the ions pass into the collisional region 430. The collisional gas 434 is selected based on its suitability for removing unwanted particles from the ion beam such as polyatomic ions in the passing plasma region 448. Using this arrangement, kinetic energy losses of the ions (as a result of the collisions with the gas particles) can be compensated for by the application of the bias voltage potential to the skimmer 426 thereby serving to increase an energy component of the ions. In one embodiment, the higher the pressure of the gas provided in the collisional region 430, the higher the bias voltage potential to be applied to skimmer 426 in order to give the ions sufficient energy to minimise collisional scatter in the event of collisions with the gas particles. This arrangement has been found to improve the signal-to-noise ratio of the mass spectrometer results in the order of >10 times that compared with conventional ICP-MS sampler interface arrangements. Therefore, using the arrangement of the present invention, suitable collisional gases may be introduced and maintained in the collisional region 430 at higher pressures (thereby increasing the removal rate of unwanted particles) while reducing the rate of scatter of incoming and available ions. The remaining ions are extracted by extraction lens 442 and directed to the mass spectrometer detector 406 for analysis.

Skimmers 426, as used in typical ICP-MS configured mass spectrometers, are generally constructed from metal and arranged to be electrically associated with a metallic vacuum chamber. This ensures the skimmer 426 is constantly grounded at substantially zero (0) voltage potential. However, in accordance with the present invention, applying a bias voltage potential to the skimmer 426 provides the additional energy potential to the ions extracted from the plasma. For example, if the kinetic energy loss within the collisional region 430 is found to be in the order of 25 electron Volts (eV), this loss can be compensated for by applying a voltage potential of around +25 Volts (V) to the skimmer 426. In cases where a quadrupole mass analyser is incorporated downstream of the skimmer 426, further benefits in addition to the reduction of collisional scatter may also be realized. In such cases, the quadrupole mass-analyser does not need to be offset (in this case by a voltage potential of −25V) in order to assist with the transfer of ions (having reduced kinetic energy). Instead, the potential of the mass analyser can be maintained at a substantially normal (zero) voltage potential thereby simplifying the operation of the apparatus. Therefore, there is no need to adjust the quadrupole voltage bias (as would normally be required) in order to assist with the transport of the ions through the quadrupole mass analyser.

In the case of a conventional ICP-MS configuration, when a collisional or reactive gas is used in a CRI atmosphere, a reduction in sensitivity due to collisional scatter can be observed to be in the order of from 10-100 times during operation. However, the application of a bias voltage potential to the skimmer, as arranged in accordance with present invention, is thought to have the potential to reduce the energy losses of the ion beam resulting in an improvement in signal sensitivity in the order of from 10 to 50 times. It will be appreciated that any magnitude of voltage potential may be applied to the skimmer 426.

The use of collisional cells in conventional ICP-MS devices has been found to increase the signal-to-noise ratio of the ion beam by >10 times compared with arrangements where they are absent. For mass spectrometry instrumentation devices incorporating collisional cells, application of a bias voltage potential to the skimmer has also been found to be advantageous as the collisional cell typically operates in a relatively high pressure environment where ion kinetic energy losses can be substantial—up to 200 eV per ion. Such collisional cells generally include quadrupole mass analysers or similar arranged therewith. This therefore means that ions passing through such collisional cell arrangements need to be extracted using negatively charged ion extraction lenses installed behind the collisional cell, and a large negative bias voltage potential applied to the quadrupole mass-analyser. However, in accordance with the present invention, the kinetic energy losses of the ions can be compensated for, or controlled to a reasonable degree, if a similar bias voltage potential (proportional to that which the collisional cell consumes) is applied to the skimmer thereby increasing the initial energy state of the ions in the ion beam (for example, up to in the order of +200 eV per ion). This has been found to improve the signal sensitivity in the order of between 10-100 times.

In view of the above, and without being bound by preliminary results, it will be appreciated that a correlation is thought to exist between the pressure of the collisional gas 434 in the collisional region 430 (or the collisional cell), and the bias voltage potential to be applied to the skimmer 426. In this regard, it may be appreciated that the lower the pressure in the collisional region 430 (indicative of less collisional scatter), the lower the bias voltage potential required to be applied to the skimmer 426. Moreover, the higher the pressure in the collisional region 430 (indicate of increased collisional scatter), the more bias voltage potential might be required to be applied to the skimmer 426. For example, an increase in the pressure of the gas in the downstream region may cause a commensurable increase in the number of ionic collisions which occur. Therefore, in one embodiment, an increase in bias voltage potential applied to the skimmer 426 may be selected so as to be commensurable with the increase in the pressure of the gas in the downstream region. However, the commensurable increase in the number of ionic collisions (as a result of the increase in gaseous pressure in the downstream region) may not translate to the same increase in collisional scatter of the ions. This is because collisional scatter is generally a function of ion energy and/or the speed of an ion prior to a collision. Accordingly, the bias voltage potential to be applied to the skimmer 426 is generally a function of the collisional scatter of the ions due to ionic collisions and may be selected experimentally (discussed further below) so as to determine the magnitude of the bias voltage potential which results in the maximum possible number of ions reaching the spectrometer detector 406.

The magnitude of the bias voltage potential applied to the skimmer 426 (or multiple skimmers as discussed below and shown in the embodiment presented in FIG. 15) is generally determined experimentally by reference to the collisional pressure recorded in the second chamber 435 (or collisional pressure in the collisional cell when included in the arrangement), and the resulting signal sensitivity or strength of the ion beam received by the mass spectrometer. One method of determining the optimum level of bias voltage potential to be applied to the skimmer 426 is by first, in the absence of any bias voltage potential applied to the skimmer 426, removing any collisional gas from the ion beam path and observing the signal sensitivity of the device. This provides an initial point of reference. Then, by introducing the desired collisional gas 434 into the collisional region 430, the signal sensitivity can be monitored as the bias voltage potential applied to the skimmer 426 is slowly increased. With increases in applied bias voltage potential to the skimmer 426, the signal sensitivity can be shown to improve. However, it has been found that a turning point will be reached where further increases in bias voltage potential serve to reduce the signal sensitivity, ie. energising the ions too much causing loss of focusing of the ion beam. Accordingly, a bias voltage potential commensurate with the 'turning point' will be a likely reflection of the optimum bias voltage potential to be applied to the skimmer 426. Furthermore, it may be that a bias voltage potential level selected within a range or band of voltage levels may prove optimal depending on the specific sampling interface arrangement used. It will also be appreciated that the optimum voltage levels (or band of voltage levels) may differ between sample ions and therefore may be characteristic of certain types of elements.

Depending on the nature of the sample ions, the relationship between the pressure of the gas in the collisional region 430 and the bias voltage potential to be applied to the skimmer 426 may be linear or non-linear, and may further depend on other factors such as, for example, the ion and collisional gas properties, and any relevant chemistry such as the ion energy, collisional, and vibrational properties. It will be appreciated that these factors are not intended to be exhaustive and that other factors may further complicate the nature of the relationship between the pressure of the gas in the collisional region 430 and the applied bias voltage potential.

Other means may also be used for determining the optimum level of the bias voltage potential. Pressure sensors (such as any suitable form of pressure transducer having sufficient sensitivity to acknowledge pressure due to colliding ions) may be located at locations throughout the collisional region 430 and arranged to transmit pressure data to a processing unit (not shown) suitably programmed to process the data and automatically adjust the applied bias voltage potential when required. The processing unit may also be arranged to receive data relating to the signal sensitivity of the device. Therefore, when provided with these data inputs, the process of determining the optimum bias voltage potential can be readily automated. It will be appreciated that similar pressure sensor and data processing arrangements may be provided in collisional cells for monitoring and/or estimating collisional activity.

Plasma sampling interface arrangements in accordance with the present invention may be used with various ICP-MS configurations as exemplified in the embodiments shown in each of FIGS. 11 to 15 which are discussed in detail below.

Figure 11:
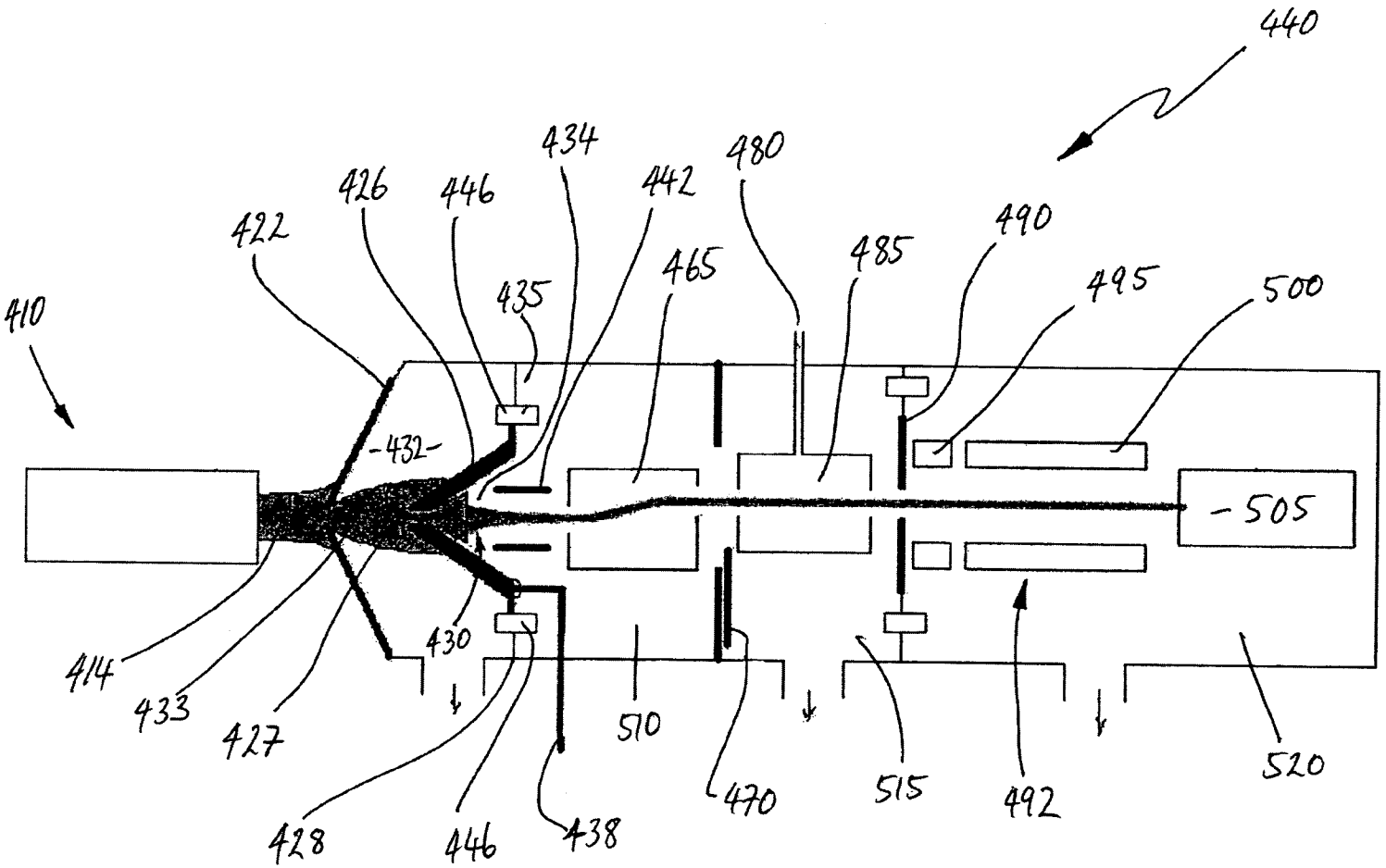
FIG. 11 shows a schematic representation of another embodiment of an ICP-MS apparatus which may be arranged for use with the present invention.

FIG. 11 shows a sampling interface 440 arranged in accordance with the present invention. For the arrangement shown, the sampling interface 440 is configured with a two aperture ICP-MS 'Campargue' interface arrangement similar to that shown in FIG. 10. As will be clear from FIG. 11, the sampling interface 440 shares a similar arrangement of components with the embodiment of the sampling interface 402 shown in FIG. 10.

As the ions pass through the aperture 427 provided in the skimmer 426, they enter the collisional region 430 defined by the second vacuum chamber 435 within which the collisional gas 434 is held. Ions which are not affected by scatter due to collision with the gas particles pass into an ion optics chamber 465 contained within a first pumping compartment 510. The ion optics chamber 465 assists with the separation from the ions of any UV photons, energetic neutrals or any solid particles that may have been carried into the instrument from the ICP, and which inadvertently avoided collision with the particles of the collisional gas 434. For the embodiment shown, the ion optics chamber 465 is arranged as an off axis configuration which acts to 'bend' the ion beam in a 'chicane' like manner. Such lens arrangements used may comprise the Omega lens (Agilent 7700 ICP-MS or the chicane lens (Thermo ICP-MS) ion optics arrangement). Ion optic arrangements of this nature seek to ensure that non-charged particles do not follow the charged ions and are removed from the ion beam (for example by colliding with an internal surface of the ion optics chamber 465).

From the ion optics chamber 465, the ion beam is directed through a gate valve 470 to a further collisional atmosphere provided within a collisional cell 485 (typically also referred to in the art as collisional cells, ion fragmentation cells, or ion manipulation cells), contained within a second pumping compartment 515. Collisional cells typically hold one or more pressurized gases such as ammonia, methane, oxygen, nitrogen, argon, neon, krypton, xenon, helium or hydrogen which reacts with the ions as an additional means of eliminating unwanted residual interfering particles. The gas(es) are introduced into the collisional cell 485 by way of inlet 480. Collisional cell 485 may be arranged to either hold one of the gases or a combination of two or more. It will be appreciated that the latter mentioned gases are by no means exhaustive and that many other gases, or combinations thereof, may be suitable for use in such collisional cells.

From collisional cell 485, the ion beam passes through a differential pumping aperture 490, held within a third pumping chamber 520, toward a mass analyser arrangement (in this instance a quadrupole mass analyser arrangement) 492. The quadrupole mass analyser arrangement 492 comprises a first set of rods (quadrupole fringing rods 495), and a second set of rods (quadrupole main rods 500) located downstream of the quadrupole fringing rods 495. In this instance, the sets of quadrupole fringing 495 and main rods 500 each comprise four (4) rods arranged parallel to one another having their respective axes arranged parallel with the direction of travel of the ion beam. The function of the quadrupole mass analyser arrangement 492 is to filter the ions in the ion beam based on their mass-to-charge ratio (m/z). For the quadrupole mass analyser arrangement 492 shown, sample ions are separated based on their stability of their trajectories in the oscillating electric fields that are applied to the rods. The remaining ions (charged ions) are then directed toward a mass spectrometer detector unit 505 for analysis.

Figure 12:
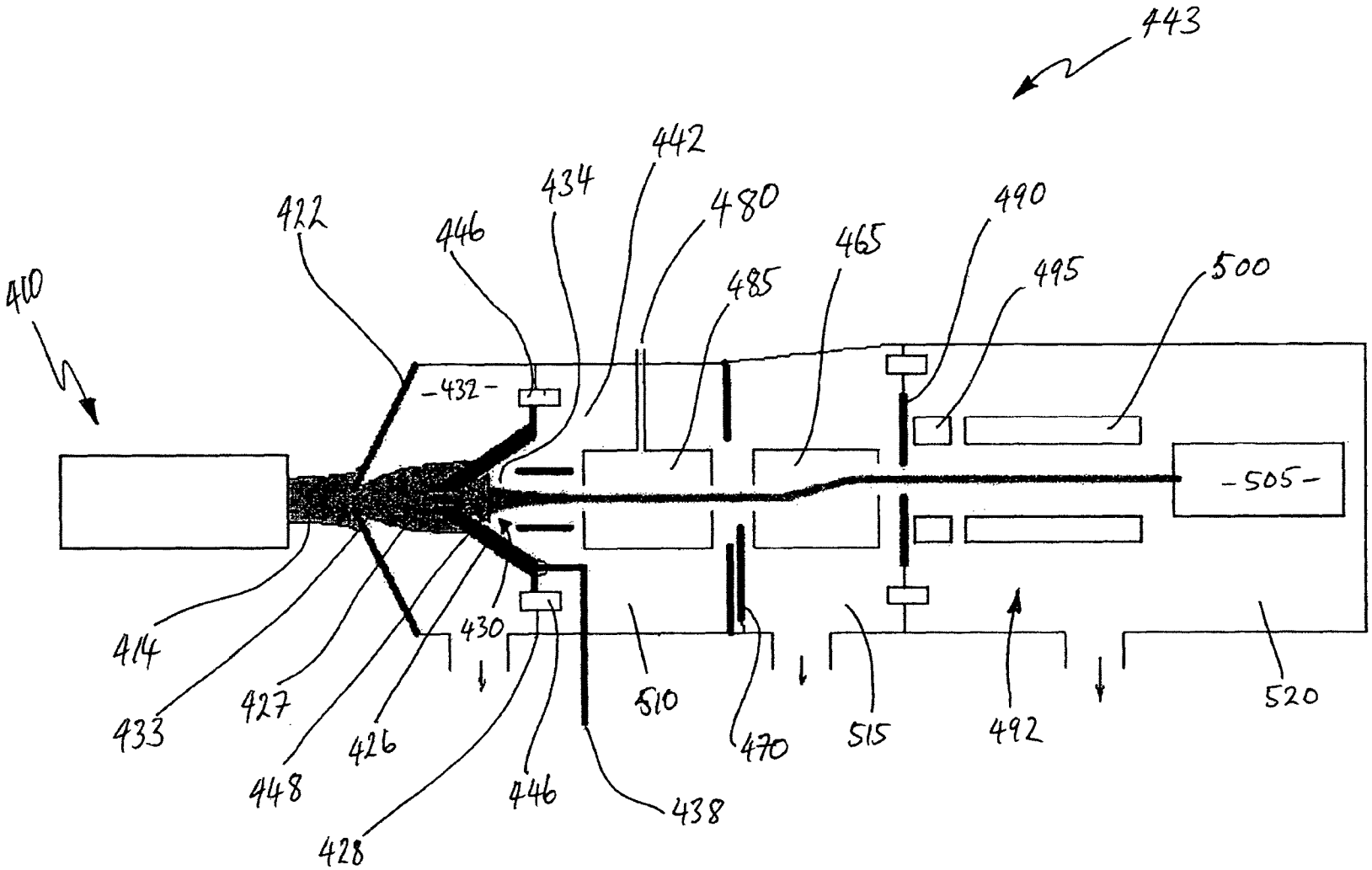
FIG. 12 shows a variation of the embodiment of the ICP-MS apparatus shown in FIG. 11.

FIG. 12 shows an embodiment of a sampling interface 443 arranged in accordance with the present invention. As will again be clear from FIG. 12, the sampling interface 443 is a variation of the embodiment shown in FIG. 8 providing the ion optics chamber 465 being arranged to reside within the second pumping chamber 515 downstream of the collisional cell 485 (now in the first pumping chamber 510).

Figure 13:
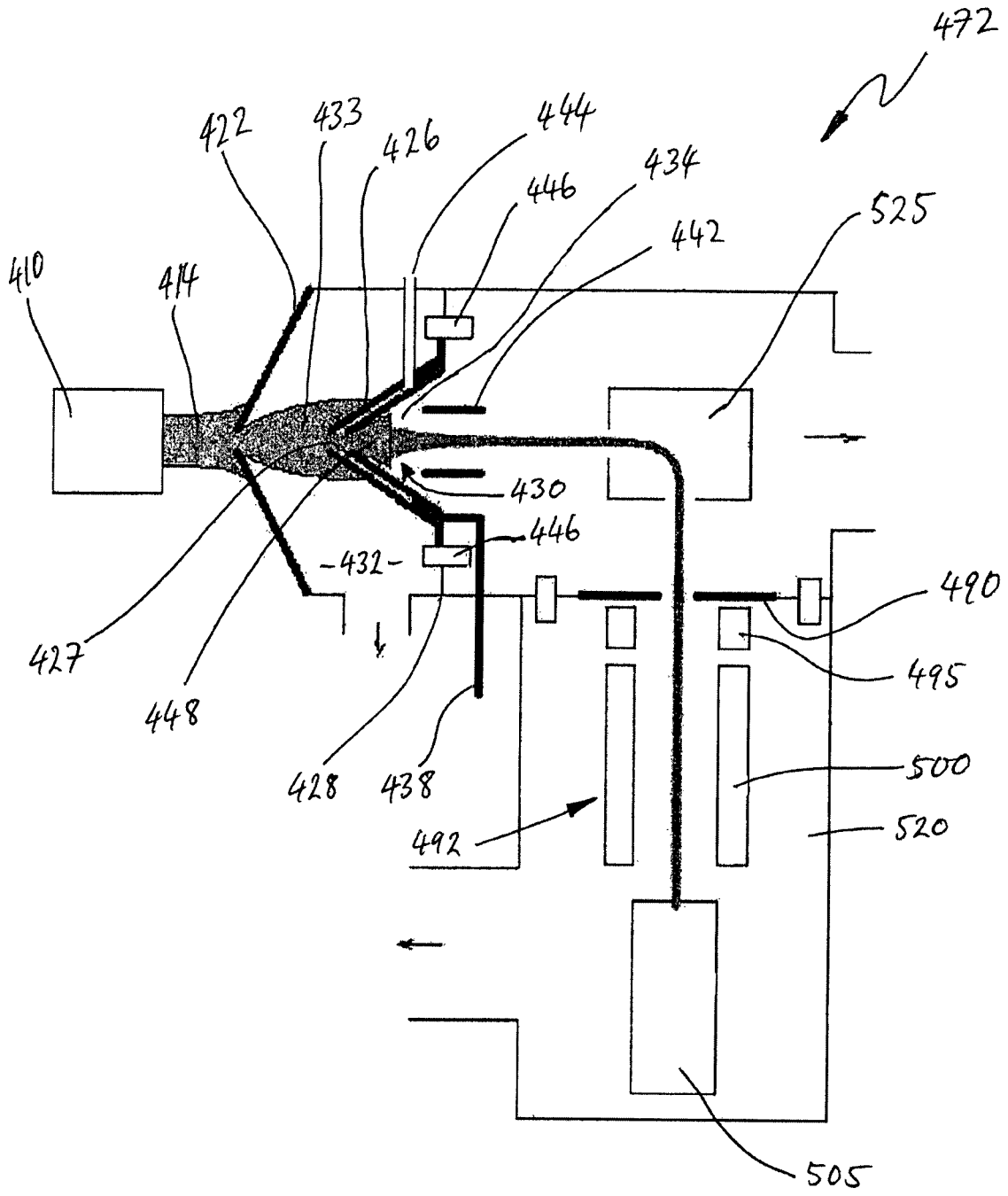
FIG. 13 shows a schematic representation of another embodiment of an ICP-MS apparatus which may be arranged for use with the present invention.

FIG. 13 shows an embodiment of a sampling interface 472 also arranged in accordance with the present invention. Similarly, many of the components shown are shared with the embodiments shown in FIGS. 13 to 15, however a modified skimmer 426 is provided having an inlet 444 which is arranged to inject the collisional gas (such as helium or hydrogen) into the plasma field 433 at or near the aperture 427 of the skimmer 426. It will be appreciated that such collisional gases may be injected into the chamber atmosphere at any suitable and desirable location within the interface.

Figure 14:
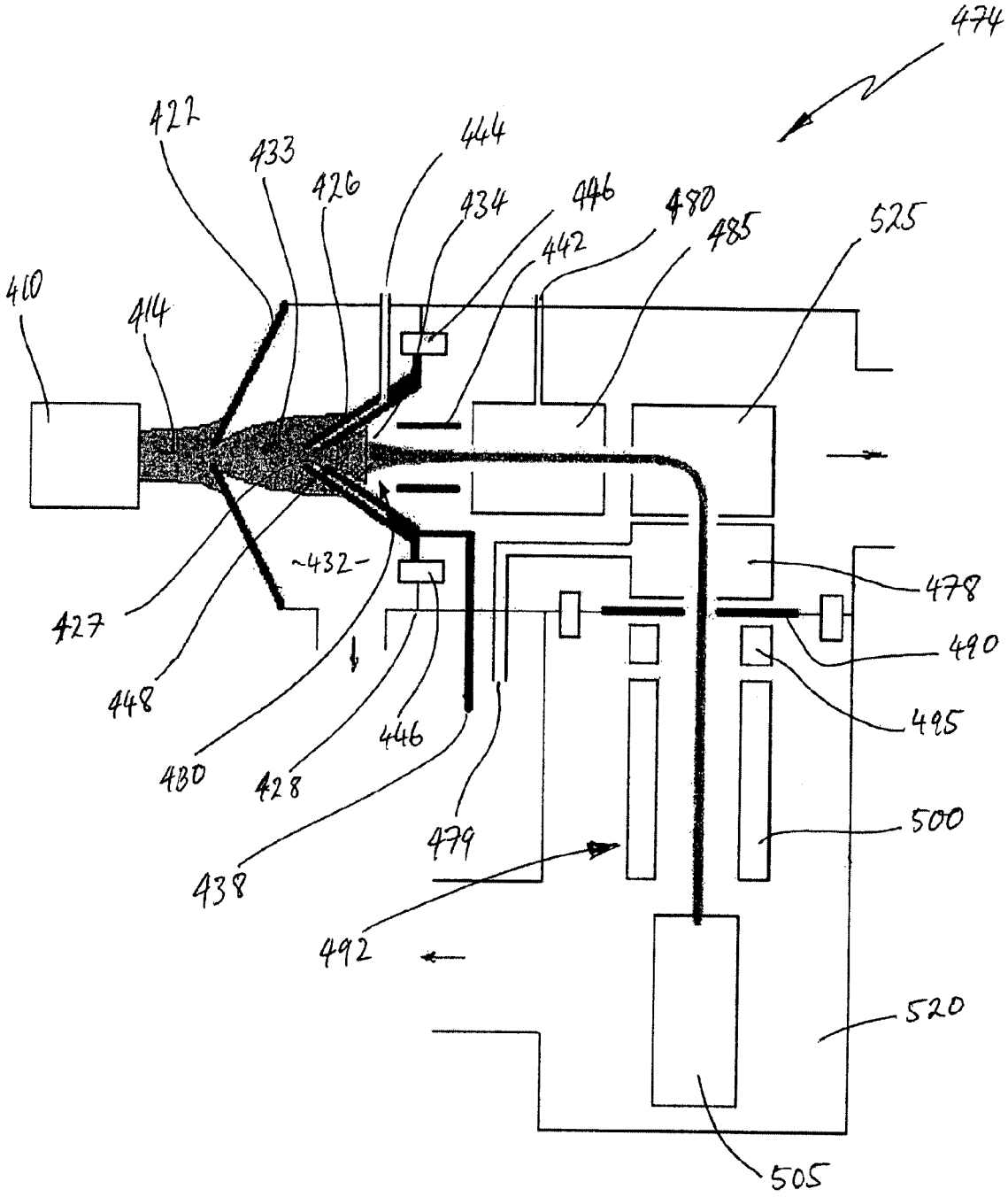
FIG. 14 shows a variation of the embodiment of the ICP-MS apparatus shown in FIG. 13; and, FIG. 15 shows another variation of the embodiment of the ICP-MS apparatus shown in FIG. 14.

An additional difference, as compared with the embodiment of the plasma sampling interface 474 shown in FIG. 14, is the incorporation of an ion 'mirror' lens 525 arranged to redirect the ion beam toward the quadrupole mass analyser 492 which is positioned in an off-axis relationship relative to the direction of travel of the ion beam from the skimmer 426. As the ion beam travels downstream from the skimmer 426, the ion mirror lens 525 is arranged having a set of electrodes configured to direct the charged particles in the ion beam to follow a different path to the accompanying non-charged particles. The electrodes in the ion mirror lens 525 may be arranged so that the ion beam can be diverted (reflected) through a substantial angle, for example 90 degrees (as shown in FIG. 13). As such, any photons or energetic neutrals that originally accompanied the ion beam as it emerged from the skimmer 426 continue in their original direction and are removed from the ion beam. It will be appreciated that arrangements of this nature can be advantageous in that the electrodes can be configured so that a degree of control can be exercised over the direction of travel of the ion beam. For example, the ion beam can be steered from side to side (ie. into or out of the plane of the drawing) by applying a voltage differential to opposite electrodes of the ion mirror 525. Further reference in this regard is made to U.S. Pat. No. 6,614,021 which is incorporated herein by reference. Use of the ion mirror lens 525 has been shown to increase the signal sensitivity of mass spectrometry devices.

FIG. 14 shows an embodiment of a sampling interface 474 arranged in accordance with the present invention. As will be clear from FIG. 14, the arrangement is substantially similar to that shown in FIG. 13, however it will be noted that the sampling interface 474 includes collisional cell 485 arranged intermediate the extraction lens 442 and the ion mirror lens 525. A further difference is the provision of a second collisional cell 478 which is positioned intermediate the ion mirror 525 and the entry into the quadrupole mass analyser 492. It will be appreciated that the second collisional cell 478 provides a further means of filtering any remaining interfering particles that may have been inadvertently diverted with the ion beam by the ion mirror lens 525. The second collisional cell 478 is arranged to receive a collisional gas via inlet 479. Although the second collisional cell 478 is provided for further refinement of the ion beam, it will be appreciated that arrangements could be realized in which it is the only collisional cell provided, ie. collisional cell 485 may be omitted in favour of the second collisional cell 478. The skilled person will further appreciate that the gases held within collisional cells 485 and 478 may be the same type of gas, different gases, or comprise a combination of one or more suitable gases.

Figure 15:
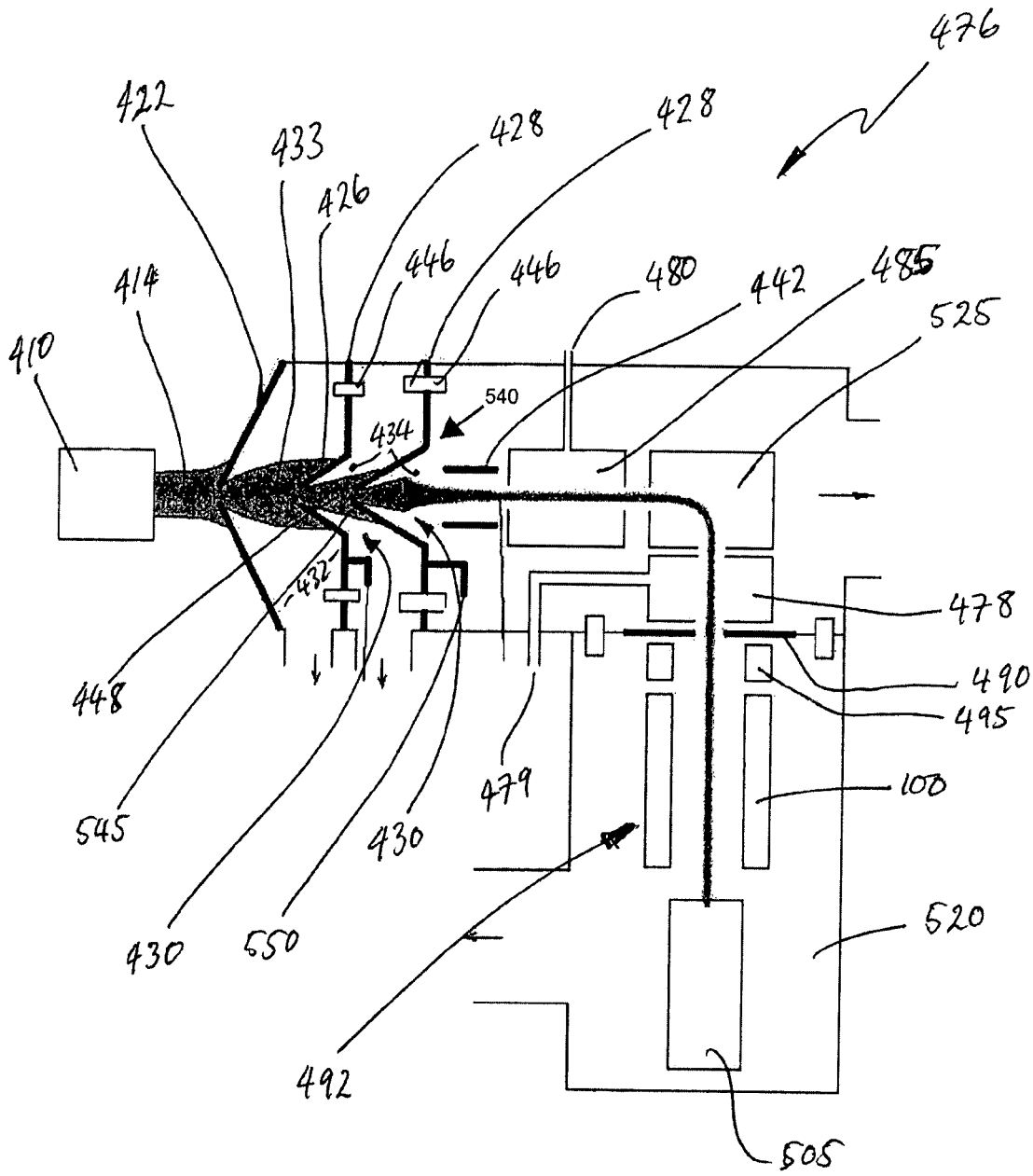

FIG. 15 shows an embodiment of a sampling interface 476 arranged in accordance with the present invention. In this embodiment, a second skimmer 540 has been included and positioned intermediate skimmer 426 and the extractions lens 442. A further voltage source 550 is provided so that a bias voltage potential may be suitably applied to the second skimmer 540.

The inclusion of the second skimmer 540 affords a further stage in which the ion beam may be refined by removing any unwanted particles. It will be seen that a further plasma expansion region 545 forms immediately downstream of the second skimmer 540 as the plasma passes en-route to a further collisional region 430'. In addition, the second skimmer 540 is also arranged to 'float' so that a bias voltage potential may be applied thereto in order to re-energise the sample ions as they pass from skimmer 426. It will be appreciated that additional skimmers may be provided and arranged in an appropriate series configuration so as to further refine the ion beam as required. Furthermore, with reference to the skimmer 426 arrangement shown in FIGS. 13 and 14, it will be appreciated that both skimmers 426 and 540 could also be modified so that a suitable gas may be injected from the periphery of respective apertures into the passing ion beam.

The word 'comprising' and forms of the word 'comprising' as used in this description and in the claims does not limit the invention claimed to exclude any variants or additions. Modifications and improvements to the invention will be readily apparent to those skilled in the art. Such modifications and improvements are intended to be within the scope of this invention.

The claims defining the invention are as follows:

1. An interface for use in sampling ions in a mass spectrometer for subsequent spectrometric analysis, the interface being capable of receiving a quantity of ions from an ion source and forming more than one ion beam therefrom, each ion beam being directed along a respective desired pathway to a respective mass analyser unit capable of filtering the ions by mass-to-charge ratio.

2. The interface according to claim 1, wherein the interface is appropriately arranged for dividing the ions at or near the ion source into separate respective ion beams which each proceed along respective desired pathways within the mass spectrometer.

3. The interface according to claim 1, wherein the interface has more than one aperture provided therein, each aperture corresponding to a respective ion beam so formed.

4. The interface according to claim 1, wherein the interface is arranged so that two or more of the desired pathways are substantially parallel with or to one another.

5. The interface according to claim 1, wherein the interface is one of substantially flat and curvilinear in shape.

6. The interface according to claim 1, wherein the interface is arranged so as to receive a bias voltage potential.

7. The interface according to claim 1, wherein the interface comprises one or more chargeable elements arranged so as to be capable of having a bias voltage potential applied thereto.

8. The interface according to claim 7, wherein the bias voltage potential applied to the interface or to the or each chargeable element is negative relative to the charge at the ion source.

9. The interface according to claim 8, wherein the or each chargeable element is one of substantially flat and curvilinear in shape.

10. The interface according to claim 7, wherein the or each chargeable element comprises more than one aperture provided therein, each aperture corresponding to a respective ion beam so formed.

11. The interface according to claim 1, wherein two or more of the desired pathways are attenuated so that the ions are directed toward, or pass through, a respective mass analyser arrangement.

12. A sampling interface for use with mass spectrometry apparatus, the sampling interface being arranged so as to enable the sampling of ions in a mass spectrometer for subsequent spectrometric analysis, the sampling interface arranged for receiving a quantity of ions extracted from an ion source and forming more than one ion beam therefrom, each ion beam being directed along a respective desired pathway to a respective mass analyser unit capable of filtering the ions by mass-to-charge ratio.

13. The sampling interface according to claim 12, wherein one or more of the pathways is attenuated so as to pass through at least one of:

(i) at least one collisional cell or reaction cell; and (ii) a respective mass analyser unit.

14. The sampling interface according to claim 12, wherein the sampling interface includes an interface arranged so as to form more than one ion beam, each ion beam having a pathway passing through a respective mass analyser unit.

15. The interface according to claim 1, wherein one or more of the ion beams pass through a region downstream of the interface which is arranged so as to minimise collisional scatter of the ions, the region being arranged for accommodating a gas through which the ions may pass.

16. The interface according to claim 15, wherein a field having a selected bias voltage potential is provided in at least a portion of the downstream region through which the ions may pass.

17. The interface according to claim 16, wherein the field having a selected bias voltage potential is provided upstream or downstream of where the ion beam is divided into more than one separate ion beams.

18. The interface according to claim 16, wherein the bias voltage potential of the field is selected so as to reduce collisional scatter caused when ions collide with particles of the gas as the ions pass through the field in the downstream region.

19. The interface according to claim 16, wherein the bias voltage potential of the field is selected in accordance with a correlation with a change in kinetic energy of the ions due to collisions with particles of the gas as the ions pass through the downstream region, so as to reduce collisional scatter.

20. The interface according to claim 16, wherein the bias voltage potential of the field is provided by a chargeable element arranged so as to be electrically coupleable to a voltage source, the chargeable element being arranged within the region so that the field is positioned relative to the desired pathway of the ions so that passing ions gain energy potential from the field.

21. The interface according to claim 20, wherein the chargeable element is arranged so as to divide passing ions into more than one separate beam of ions.

22. A plasma sampling interface for plasma mass spectrometry apparatus, the plasma sampling interface arranged so as to enable the sampling of ions from a plasma and introduction of the ions to a mass spectrometer for subsequent spectrometric analysis, the ions to be sampled being from a sample which has been converted into ions in the plasma, the plasma sampling interface arranged for receiving a quantity of ions extracted from the ion source and forming more than one ion beam, each ion beam being directed along a respective desired pathway to a respective mass analyser unit capable of filtering the ions by mass-to-charge ratio.

23. A method of measuring a quantity of ions extracted from a sample, the method comprising forming more than one ion beam and directing each ion beam along a respective intended pathway to a respective mass analyser unit capable of filtering the ions by mass-to-charge ratio.

24. The method according to claim 23, the method further including directing one or more of said more than one ion beams so that they pass through a region arranged having a gas through which the ions may pass, the field having a selected bias voltage potential provided in at least a portion of the region through which the ions may pass.

* * * * *